US010915064B2

(12) United States Patent
Yoshimoto et al.

(10) Patent No.: US 10,915,064 B2
(45) Date of Patent: Feb. 9, 2021

(54) IMAGE FORMING APPARATUS INCLUDING DRUM CARTRIDGE HAVING PHOTOSENSITIVE DRUM AND TONER CARTRIDGE HAVING DEVELOPING ROLLER

(71) Applicant: BROTHER KOGYO KABUSHIKI KAISHA, Nagoya (JP)

(72) Inventors: Shunji Yoshimoto, Nagoya (JP); Naoya Kamimura, Ichinomiya (JP); Masashi Imai, Kasugai (JP); Masaki Ueji, Nagoya (JP); Keita Hironaka, Obu (JP); Hotaka Kakutani, Kiyosu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/828,198

(22) Filed: Mar. 24, 2020

(65) Prior Publication Data

US 2020/0310344 A1 Oct. 1, 2020

(30) Foreign Application Priority Data

Mar. 28, 2019 (JP) ..... 2019-062588
Mar. 28, 2019 (JP) ..... 2019-062594

(51) Int. Cl.
*G03G 21/18* (2006.01)
*G03G 15/08* (2006.01)
*G03G 15/00* (2006.01)

(52) U.S. Cl.
CPC ..... *G03G 21/1889* (2013.01); *G03G 15/0863* (2013.01); *G03G 15/556* (2013.01); *G03G 2221/1823* (2013.01)

(58) Field of Classification Search
CPC ..... G03G 15/065; G03G 21/1889; G03G 15/0863; G03G 15/556
See application file for complete search history.

(56) References Cited

U.S. PATENT DOCUMENTS 6,229,970 B1 5/2001 Onimura et al.
6,597,876 B1 7/2003 Sakurai et al.
(Continued)

FOREIGN PATENT DOCUMENTS

JP 9-120198 A 5/1997
JP 9-190058 A 7/1997
(Continued)

*Primary Examiner* — Walter L Lindsay, Jr.
*Assistant Examiner* — Jessica L Eley
(74) *Attorney, Agent, or Firm* — Merchant & Gould P.C.

(57) ABSTRACT

An image forming apparatus includes a controller, a drum cartridge and a toner cartridge. The controller is configured to perform determining a value of a first initial developing bias for a first toner cartridge based on a cumulative number of drum rotations that is stored in a drum memory of the drum cartridge at the time when the cumulative dot count stored in the toner memory of the first toner cartridge is equal to zero. After determining the first initial developing bias, the controller is configured to perform determining a value of a second initial developing bias for a second toner cartridge based on the cumulative number of drum rotations that is stored in the drum memory at the time when the cumulative dot count stored in the toner memory of the second toner cartridge is equal to zero.

28 Claims, 12 Drawing Sheets

(56) References Cited

U.S. PATENT DOCUMENTS

| | | | | |
|---|---|---|---|---|
| 2002/0018658 | A1* | 2/2002 | Sakai | G03G 21/1889 399/38 |
| 2006/0201889 | A1* | 9/2006 | Nakasendo | G03G 15/553 210/737 |
| 2009/0269086 | A1* | 10/2009 | Mikuni | G03G 15/0856 399/12 |
| 2013/0308969 | A1* | 11/2013 | Hasegawa | G03G 15/0266 399/50 |
| 2019/0302640 | A1* | 10/2019 | Sano | G03G 21/1825 |

FOREIGN PATENT DOCUMENTS

| | | | |
|---|---|---|---|
| JP | 2001-117425 | A | 4/2001 |
| JP | 2001-117468 | A | 4/2001 |
| JP | 2001-312110 | A | 11/2001 |
| JP | 2002-6569 | A | 1/2002 |
| JP | 2009-265401 | A | 11/2009 |

* cited by examiner

IMAGE FORMING APPARATUS INCLUDING DRUM CARTRIDGE HAVING PHOTOSENSITIVE DRUM AND TONER CARTRIDGE HAVING DEVELOPING ROLLER

CROSS REFERENCE TO RELATED APPLICATION

This application claims priorities from Japanese Patent Applications No. 2019-062588 filed Mar. 28, 2019 and No. 2019-062594 filed Mar. 28, 2019. The entire contents of the priority applications are incorporated herein by reference.

TECHNICAL FIELD

The present disclosure relates to an image forming apparatus to which a drum cartridge and a toner cartridge are detachably attachable.

BACKGROUND

There has been conventionally known an image forming apparatus to which a drum cartridge and a toner cartridge are detachably attachable. In the conventional image forming apparatus, the drum cartridge is mounted on the image forming apparatus after the toner cartridge is attached to the drum cartridge.

Generally, the lifetime of a drum cartridge is longer than the lifetime of a toner cartridge. Accordingly, a plurality of toner cartridges are used in succession with respect to a single drum cartridge such that when toner runs out in one toner cartridge, for example, the toner cartridge is replaced with the next toner cartridge.

SUMMARY

However, if the initial toner cartridge and the subsequent toner cartridges are used under the same conditions, the amount of toner supplied from a toner cartridge to the drum cartridge may vary among the respective toner cartridges, failing to stabilize print density.

The disclosure has been made in view of the above-described problem and an object thereof is to stabilize the print density of an image forming apparatus.

According to one aspect, the disclosure provides an image forming apparatus including an apparatus body, a controller, a drum cartridge and a toner cartridge. The drum cartridge is detachably attachable to the apparatus body. The drum cartridge includes a photosensitive drum and a drum memory. The drum memory stores data of a cumulative number of drum rotations of the photosensitive drum. The toner cartridge is configured to be used to perform image formation together with the drum cartridge. A first toner cartridge is used as the toner cartridge, before a second toner cartridge is used as the toner cartridge. The toner cartridge includes a developing roller and a toner memory. The developing roller is configured to be applied with a developing bias. A first developing bias is the developing bias applied to the developing roller of the first toner cartridge. A second developing bias is the developing bias applied to the second toner cartridge. The toner memory stores data of a cumulative dot count. An initial developing bias is the developing bias that is applied to the developing roller of the toner cartridge when the cumulative dot count stored in the toner memory of the toner cartridge is equal to zero. A first initial developing bias is the initial developing bias for the first toner cartridge. A second initial developing bias is the initial developing bias for the second toner cartridge. The controller is configured to perform determining a value of the first initial developing bias based on the cumulative number of drum rotations that is stored in the drum memory at the time when the cumulative dot count stored in the toner memory of the first toner cartridge is equal to zero. After determining the first initial developing bias, the controller is configured to perform determining a value of the second initial developing bias based on the cumulative number of drum rotations that is stored in the drum memory at the time when the cumulative dot count stored in the toner memory of the second toner cartridge is equal to zero. The value of the second initial developing bias is different from the value of the first initial developing bias.

According to another aspect, the disclosure provides an image forming apparatus including an apparatus body, a controller, a drum cartridge and a toner cartridge. The drum cartridge is detachably attachable to the main body. The drum cartridge includes a photosensitive drum, at least one of a transfer roller and a cleaning roller and a drum memory. Each of the transfer roller and the cleaning roller faces the photosensitive drum. The transfer roller is configured to be applied with a transfer current. The cleaning roller is configured to be applied with a cleaning bias. The drum memory stores data of a cumulative number of drum rotations of the photosensitive drum. The toner cartridge is configured to be used to perform image formation together with the drum cartridge. A first toner cartridge is used as the toner cartridge before a second toner cartridge is used as the toner cartridge. A first transfer current is the transfer current applied to the transfer roller when the first toner cartridge is used. A second transfer current is the transfer current applied to the transfer roller when the second toner cartridge is used. A first cleaning bias is the cleaning bias applied to the cleaning roller when the first toner cartridge is used. A second cleaning bias is the cleaning bias applied to the cleaning roller when the second toner cartridge is used. The toner cartridge includes a cartridge housing, a developing roller and a toner memory. The cartridge housing accommodates toner therein. The toner memory stores data of a cumulative dot count. An initial transfer current is the transfer current that is applied to the transfer roller when the cumulative dot count stored in the toner memory of the toner cartridge is equal to zero. A first initial transfer current is the initial transfer current that is applied to the transfer roller when the first toner cartridge is used. A second initial transfer current is the initial transfer current that is applied to the transfer roller when the second toner cartridge is used. An initial cleaning bias is the cleaning bias that is applied to the cleaning roller of the drum cartridge when the cumulative dot count stored in the toner memory of the toner cartridge is equal to zero. A first initial cleaning bias is the initial cleaning bias when the first toner cartridge is used. A second initial cleaning bias is the initial cleaning bias when the second toner cartridge is used. In a case where the drum cartridge includes the transfer roller, the controller is configured to perform determining a value of the first initial transfer current based on the cumulative number of drum rotations that is stored in the drum memory at the time when the cumulative dot count stored in the toner memory of the first toner cartridge is equal to zero. After determining the first initial transfer current, the controller is configured to perform determining a value of the second initial transfer current based on the cumulative number of drum rotations that is stored in the drum memory at the time when the cumulative dot count stored in the toner memory of the second toner cartridge is equal to zero. The value of the second initial transfer current is different from the value of the first initial transfer current. In a case where the drum cartridge includes the cleaning roller, the controller is configured to perform determining a value of the initial cleaning bias based on the cumulative number of drum rotations that is stored in the drum memory at the time when the cumulative dot count stored in the toner memory of the first toner cartridge is equal to zero. After determining the first initial cleaning bias, the controller is configured to perform determining a value of the second initial cleaning bias based on the cumulative number of drum rotations that is stored in the drum memory at the time when the cumulative dot count stored in the toner memory of the second toner cartridge is equal to zero. The value of the second initial cleaning bias is different from the value of the first initial cleaning bias.

BRIEF DESCRIPTION OF THE DRAWINGS

The particular features and advantages of the disclosure will become apparent from the following description taken in connection with the accompanying drawings, in which.

DETAILED DESCRIPTION

Hereinafter, a first embodiment of the present disclosure will be described in detail with reference to FIGS. 1 through 8B as necessary.

Figure 1:
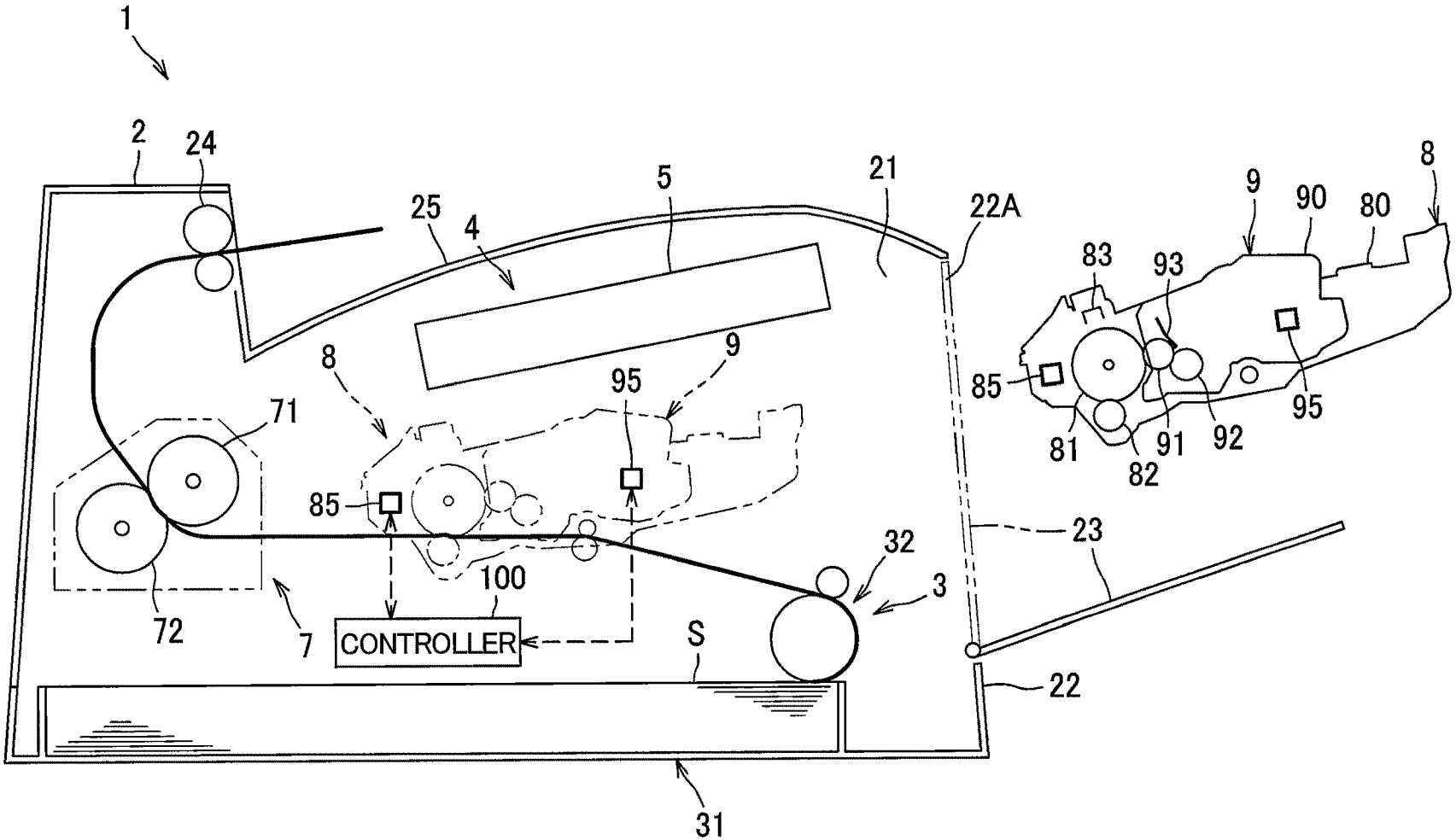
FIG. 1 is a cross sectional view of an image forming apparatus according to a first embodiment of the present disclosure.

As illustrated in FIG. 1, an image forming apparatus 1 is a monochrome laser printer. The image forming apparatus 1 has an apparatus body 2, a feeder part 3, an image forming part 4, and a controller 100.

The apparatus body 2 is a case formed into a hollow shape. The apparatus body 2 has a pair of left and right side walls 21 and a front wall 22 connecting the side walls 21. The front wall 22 has an opening 22A. The front wall 22 is provided with a front cover 23 for opening/closing the opening 22A.

The feeder part 3 has a feed tray 31 and a feed mechanism 32. The feed tray 31 is detachably attached to a lower portion of the apparatus body 2. The feed mechanism 32 feeds a sheet S stored in the feed tray 31 toward the image forming part 4.

The image forming part 4 has a scanner unit 5, a fixing device 7, a drum cartridge 8, and a toner cartridge 9.

The scanner unit 5 is provided at an upper part of the apparatus body 2 and includes a laser emitting part, a polygon mirror, a lens, and a reflecting mirror, which are not illustrated. The scanner unit 5 irradiates the surface of a photosensitive drum 81 (described later) with laser beam in a high-speed scanning motion.

The controller 100 has, for example, a CPU, a RAM, a ROM, and an input/output circuit. The controller 100 performs arithmetic processing based on information related to the attached cartridge or program/data stored in the ROM to thereby execute print control. As described later, data shown in FIGS. 3, 4A-4D, 5A, 6A, 7A and 8A is stored in the ROM of the controller 100.

The drum cartridge 8 is detachably attached to the apparatus body 2 of the image forming apparatus 1. Specifically, the drum cartridge 8 is detachably attached to the apparatus body 2 through the opening 22A opened by the front cover 23 of the apparatus body 2. The drum cartridge 8 is disposed at a position between the feeder part 3 and the scanner unit 5 when the drum cartridge 8 is attached to the apparatus body 2. The toner cartridge 9 is detachably attached to the drum cartridge 8. The toner cartridge 9 is detached from or attached to the apparatus body 2 in a state where the toner cartridge 9 has been assembled to the drum cartridge 8. That is, when the toner cartridge 9 is replaced with a next one, the drum cartridge 8 and the toner cartridge 9 are integrally removed from and attached to the image forming apparatus 1.

The lifetime of the drum cartridge 8 is longer than the lifetime of the toner cartridge 9. Here, the lifetime is determined from the total number of prints or the total number of printable dots. Thus, while the same, single drum cartridge 8 is used, a plurality of different toner cartridges 9 are used in succession such that when the lifetime of a toner cartridge 9 currently attached to the drum cartridge 8 has been reached, the toner cartridge 9 is replaced with a new one. For example, three to five toner cartridges 9 may be used in succession for one drum cartridge 8. This means that the lifetime of the drum cartridge 8 is approximately three to five times as long as the lifetime of the toner cartridge 9.

In the present embodiment, while one drum cartridge 8 is used in the image forming apparatus 1, a plurality of toner cartridges 9 are used in succession. A toner cartridge 9 that is used first among the plurality of toner cartridges 9 will be referred to as a first toner cartridge 9. A toner cartridge 9 that is used second among the plurality of toner cartridge 9 will be referred to as a second toner cartridge 9. A toner cartridge 9 that is used third among the plurality of toner cartridges 9 will be referred to as a third toner cartridge 9. A toner cartridge 9 that is used fourth among the plurality of toner cartridges 9 will be referred to as a fourth toner cartridge 9. A toner cartridge 9 that is used fifth among the plurality of toner cartridges 9 will be referred to as a fifth toner cartridge 9. To summarize, a toner cartridge 9 that is used X-th in the series of the toner cartridge 9 (where X is an integer greater than zero (0)) will be referred to as an X-th toner cartridge 9.

The drum cartridge 8 has a frame 80, a photosensitive drum 81, a transfer roller 82, a charger 83, and a drum memory 85. The toner cartridge 9 can be detachably attached to the frame 80. The photosensitive drum 81 is rotatably supported by the frame 80.

The toner cartridge 9 has a housing 90, a developing roller 91, a supply roller 92, a blade 93, and a toner memory 95. The housing 90 stores toner therein. The supply roller 92 supplies toner stored in the housing 90 to the developing roller 91. The developing roller 91 supplies toner to the photosensitive drum 81. The blade 93 restricts the layer thickness of the toner supplied to the developing roller 91.

In the drum cartridge 8, while the photosensitive drum 81 is rotating, the surface of the photosensitive drum 81 is uniformly charged by the charger 83 and then exposed by the high-speed scanning of the laser beam from the scanner unit 5. As a result, the potential of the exposed portion decreases and an electrostatic latent image based on image data is formed on the surface of the photosensitive drum 81.

Subsequently, the toner stored in the toner cartridge 9 is supplied to the electrostatic latent image on the photosensitive drum 81 by the rotationally driven developing roller 91, whereby a toner image is formed on the surface of the photosensitive drum 81. Thereafter, a sheet S is conveyed to a position between the photosensitive drum 81 and the transfer roller 82, and the toner image carried on the surface of the photosensitive drum 81 is transferred onto the sheet S.

The fixing device 7 has a heating roller 71 and a pressing roller 72. The pressing roller 72 is positioned so as to face the heating roller 71. The pressing roller 72 presses the heating roller 71. The fixing device 7 thermally fixes the toner image transferred onto the sheet S while the sheet S is passing between the heating roller 71 and the pressing roller 72.

The sheet S onto which the toner image has been thermally fixed by the fixing device 7 is conveyed to a sheet discharge roller 24 provided downstream from the fixing device 7 and then fed onto a sheet discharge tray 25 by the sheet discharge roller 24.

The drum memory 85 of the drum cartridge 8 is a medium that stores information of the drum cartridge 8. The drum memory 83 is, for example, an IC chip, but is not limited to the IC chip. The drum memory 85 stores therein data of a cumulative number of drum rotations "N" of the photosensitive drum 81 that is counted by the controller 100. Here, the cumulative number of drum rotations "N" indicates how many times the photosensitive drum 81 has been rotated since the drum cartridge 8 was newly attached to the image forming apparatus 1 and while the drum cartridge 8 has been used in the image forming apparatus 1. In other words, the cumulative number of drum rotations "N" is the total number of drum rotations that have been attained since the drum cartridge 8 was newly attached to the image forming apparatus 1 and while the drum cartridge 8 has been used in the image forming apparatus 1. Even when the drum cartridge 8 is removed from the image forming apparatus 1 and attached to the image forming apparatus 1 again before the lifetime of the drum cartridge 8 has been reached, the controller 100 continues updating the cumulative number of drum rotations "N" without initializing the cumulative number of drum rotations "N". As described later, it is noted that charging capability of the photosensitive drum 81 degrades as the cumulative number of drum rotations "N" increases.

The toner memory 95 of the toner cartridge 9 is a medium that stores information of the toner cartridge 9. The toner memory 95 is, for example, an IC chip, but is not limited to the IC chip. The toner memory 95 stores therein, for example, a cumulative number of rotations of the developing roller 91, a cumulative dot count "n" which is the cumulative number of developed dots counted by the controller 100, and a toner residual amount. In the present embodiment, the toner memory 95 stores at least the cumulative dot count "n". Here, the cumulative dot count "n" indicates the accumulated number of dots that have been developed since the toner cartridge 9 was newly mounted in the image forming apparatus 1 and while the toner cartridge 9 has been used. In other words, the cumulative dot count is the total number of dots that have been attained since the toner cartridge 9 was newly mounted in the image forming apparatus 1 and while the toner cartridge 9 has been used. Even when the toner cartridge 9 is removed from the image forming apparatus 1 and attached to the image forming apparatus 1 again before the lifetime of the toner cartridge 9 has been reached, the controller 100 continues updating the cumulative dot count "n" without initializing the cumulative dot count "n".

Figure 2:
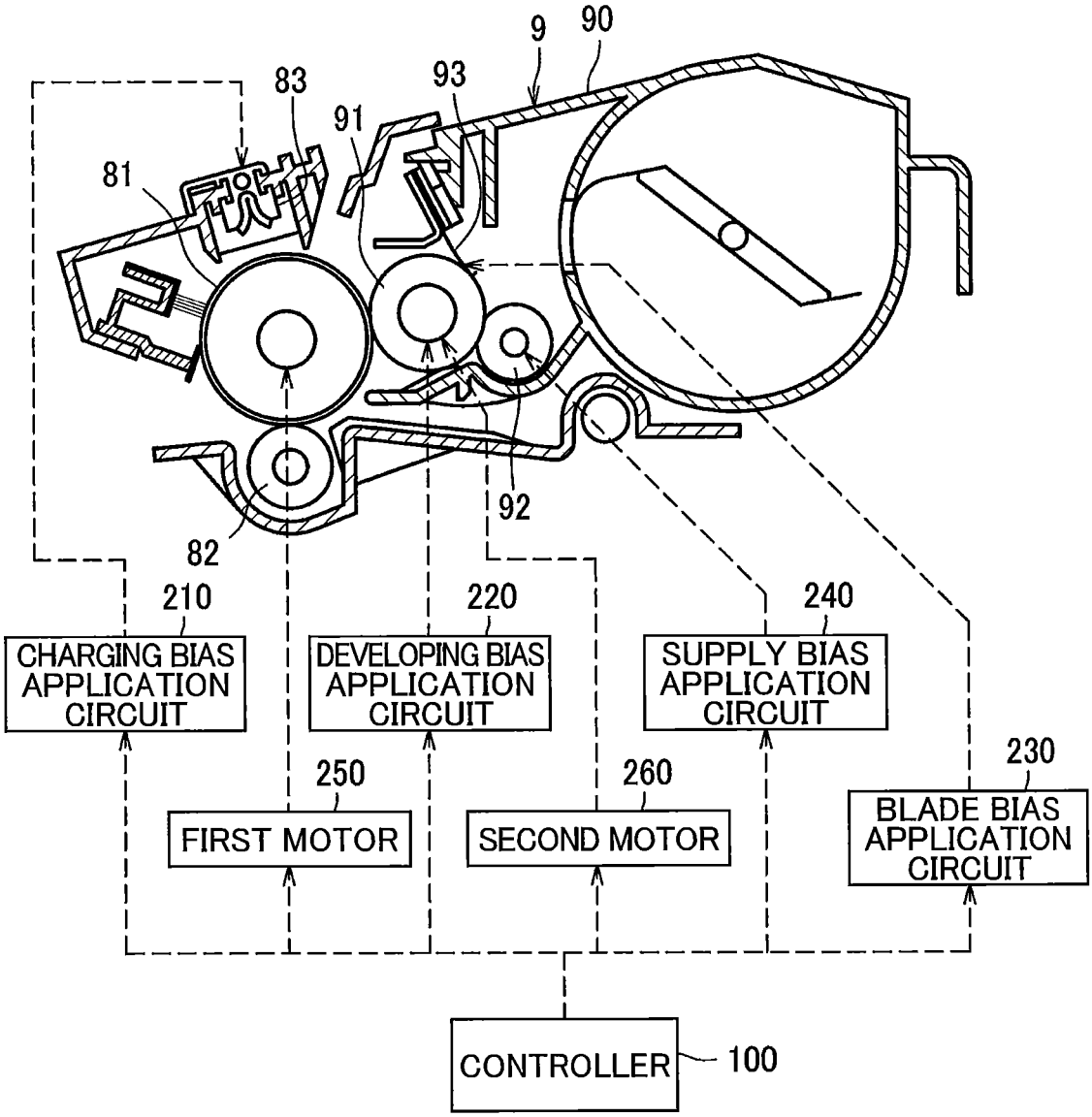
FIG. 2 is a conceptual diagram illustrating connection between a charging bias application circuit, a developing bias application circuit, a blade bias application circuit, a supply bias application circuit, and motors, according to the first embodiment.

As illustrated in FIG. 2, the image forming apparatus 1 further has a charging bias application circuit 210, a developing bias application circuit 220, a blade bias application circuit 230, a supply bias application circuit 240, a first motor 250, and a second motor 260.

In the present embodiment, positively charged type toner is used. Correspondingly, the charging bias application circuit 210, developing bias application circuit 220, blade bias application circuit 230, and supply bias application circuit 240 are each applied with positive bias voltage.

Figure 3:
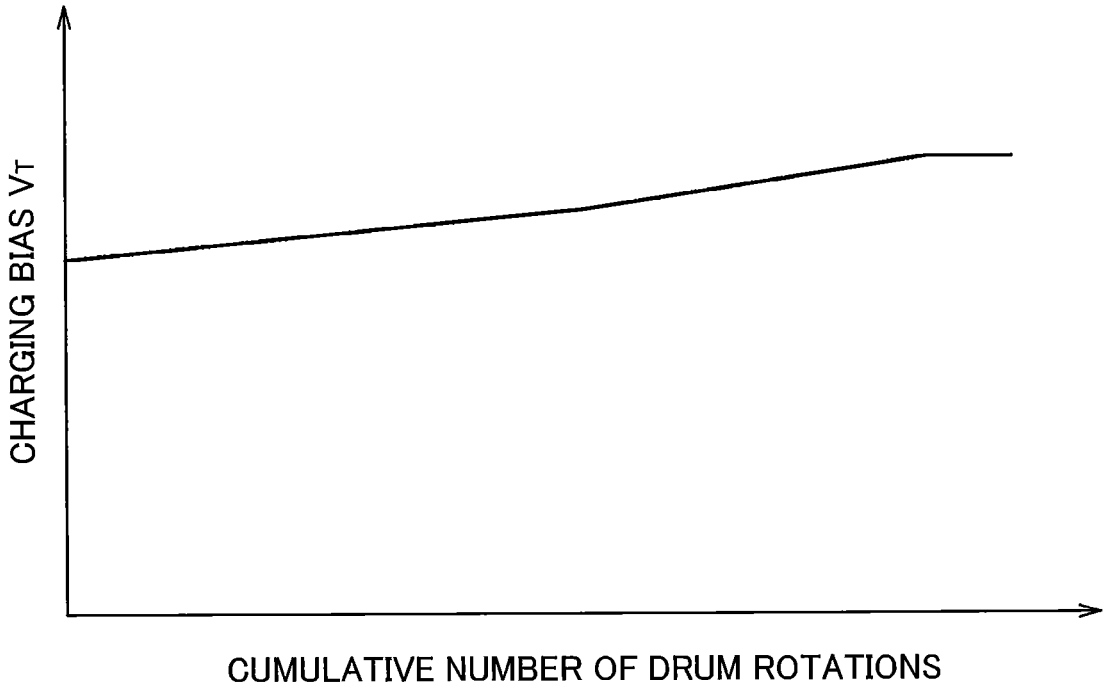
FIG. 3 is a graph showing a relationship between a cumulative number of drum rotations and a charging bias according to the first embodiment.

The charging bias application circuit 210 is a circuit for applying a charging bias $V_T$ to the charger 83. The value of the charging bias applied by the charging bias application circuit 210 is controlled by the controller 100. Specifically, as illustrated in FIG. 3, the controller 100 controls the charging bias application circuit 210 such that the value of the charging bias $V_T$ gradually increases as the cumulative number of drum rotations "N" of the photosensitive drum 81 increases. The relationship (FIG. 3) between the cumulative number of drum rotations "N" and the charging bias $V_T$ is determined such that the surface potential (electric potential) of the photosensitive drum will become constant even when the cumulative number of drum rotations "N" of the photosensitive drum 81 increases. The relationship of FIG. 3 is determined based on experimental data which is previously acquired. The data of the relationship between the cumulative number of drum rotations "N" and the charging bias $V_T$ shown in FIG. 3 is stored in the ROM of the controller 100. By controlling the charging bias $V_T$ in accordance with the relationship of FIG. 3, even though the charging capability of the photosensitive drum 81 degrades with an increase in the cumulative number of drum rotations "N", the degradation of the charging capability can be complemented.

Referring back to FIG. 2, the developing bias application circuit 220 is a circuit for applying a developing bias $V_G$ to the developing roller 91. The controller 100 determines the value of the developing bias $V_G$ according to both of the cumulative number of drum rotations "N", which is stored in the drum memory 85 of the drum cartridge 8 currently attached to the image forming apparatus 1, and the cumulative dot count "n", which is stored in the toner memory 95 of the toner cartridge 9 currently attached to the drum cartridge 8, and controls the developing bias application circuit 220 to apply the determined developing bias $V_G$ to the developing roller 91.

Specifically, the controller 100 determines the value of the developing bias $V_{GX}$ for an X-th toner cartridge 9 by adding a developing bias reference value $V_{G(n)}$, which varies according to the cumulative dot count "n", and a developing bias correction amount $V_{MG(N)}$, which varies according to the cumulative number of drum rotations "N" ($V_{GX(n,\ N)}=V_{G(n)}+V_{MG(N)}$), wherein X is an integer greater than zero (0).

Figure 4A:
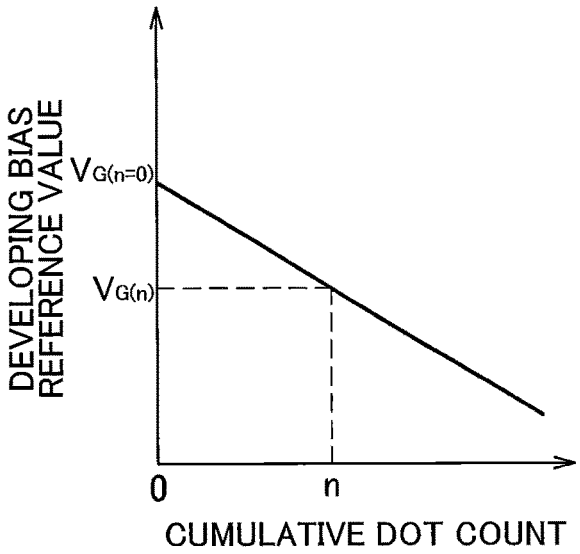
FIG. 4A is a graph showing a relationship between a cumulative dot count and a developing bias reference value according to the first embodiment.

FIG. 4A shows a relationship between the cumulative dot count "n" and the developing bias reference value $V_{G(n)}$ that should be satisfied while a single toner cartridge 9 is used for image formation, that is, after the toner cartridge 9 is newly attached to the drum cartridge 8 and until the toner cartridge 9 is replaced with a next one. The relationship (FIG. 4A) between the cumulative dot count "n" and the developing bias reference value $V_{G(n)}$ is previously determined to ensure that the amount by which toner is moved from the developing roller 91 to the photosensitive drum 81 will become constant even when the characteristics of the toner degrades with an increase in the dot count. It is noted that data of the relationship of FIG. 4A is previously determined based on previously-acquired experimental data, and is previously stored in the ROM of the controller 100. As illustrated in FIG. 4A, the developing bias reference value $V_{G(n)}$ is equal to $V_{G(n=0)}$ when the cumulative dot count "n" is equal to zero (n=0). The absolute value of the developing bias reference value $V_{G(n)}$ gradually decreases as the cumulative dot count "n" increases.

Figure 5A:
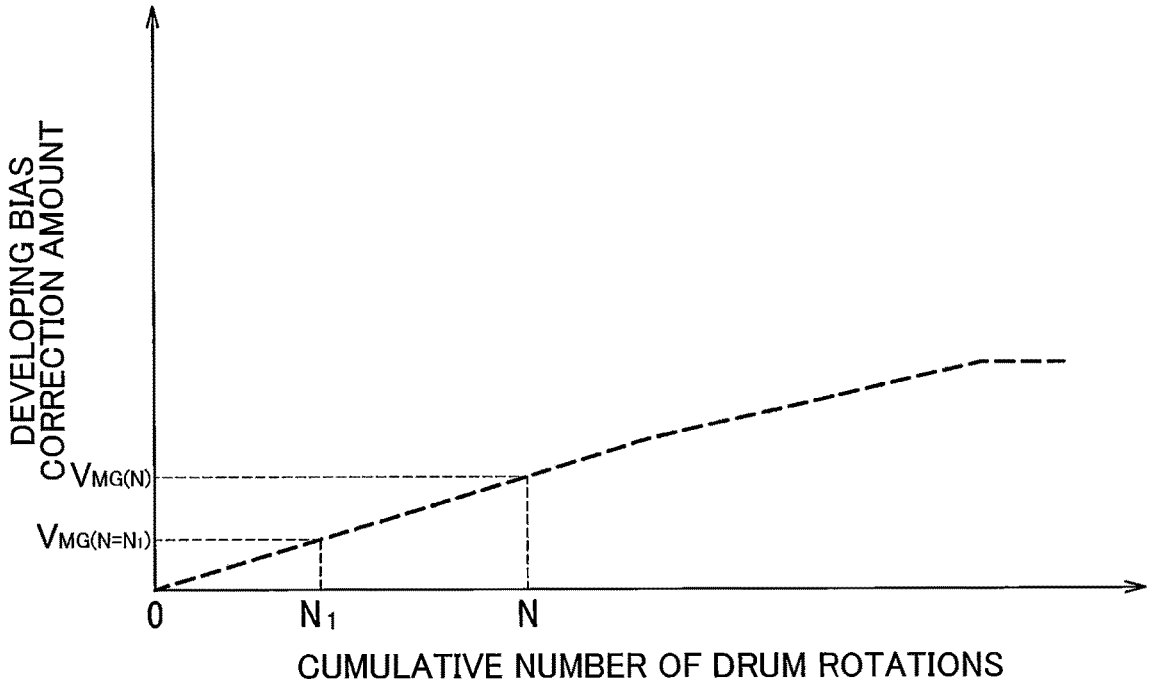
FIG. 5A is a graph showing a relationship between the cumulative number of drum rotations and a developing bias correction amount according to the first embodiment.

FIG. 5A shows the relationship between the cumulative number of drum rotations "N" and the developing bias correction amount $V_{MG(N)}$ that should be satisfied while a single drum cartridge 8 is used for image formation, that is, after the drum cartridge 8 is newly attached to the image forming apparatus 1 and until the drum cartridge 8 is replaced with a next one. The relationship (FIG. 5A) between the cumulative number of drum rotations "N" and the developing bias correction amount $V_{MG(N)}$ is previously determined to ensure that even when the characteristics of photosensitive drum 81 degrade with an increase in the cumulative number of drum rotations "N", the amount of toner adhering to the photosensitive drum 81 will become constant. It is noted that data of the relationship of FIG. 5A is previously determined based on previously-acquired experimental data, and is previously stored in the ROM of the controller 100. As illustrated in FIG. 5A, the developing bias correction amount $V_{MG(N)}$ is equal to zero (0) when the cumulative number of drum rotations "N" is equal to zero (N=0). The absolute value of the developing bias correction amount $V_{MG(N)}$ gradually increases as the cumulative number of drum rotations "N" increases.

Figure 5B:
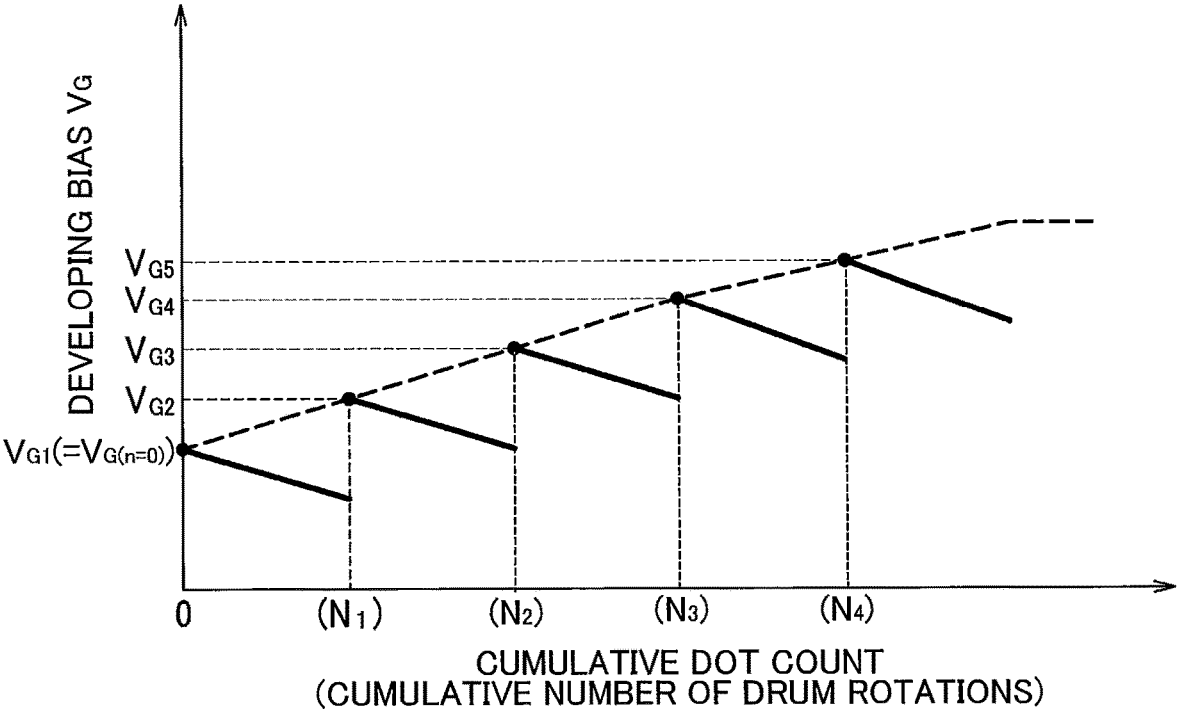
FIG. 5B is a graph showing a relationship between the cumulative dot count (the cumulative number of drum rotations) and a developing bias in a case where a plurality of toner cartridges are used in succession for one drum cartridge according to the first embodiment.

As illustrated in FIG. 5B, the controller 100 determines an initial developing bias for the X-th toner cartridge 9 based on the cumulative number of drum rotations "N" that is stored at the time when the X-th toner cartridge 9 is newly assembled to the drum cartridge 8. Here, the initial developing bias for the X-th toner cartridge 9 is a developing bias to be applied to the developing roller 91 at an initial stage of the image formation performed by the X-th toner cartridge 9 together with the drum cartridge 8. In other words, the initial developing bias for the X-th toner cartridge 9 is a developing bias that is applied to the developing roller 91 when the cumulative dot count "n" stored in the toner memory 95 of the X-th toner cartridge 9 is equal to zero (0). More specifically, when the drum cartridge 8 is also new, both of the cumulative number of drum rotations "N" stored in the drum memory 85 and the cumulative dot count "n" stored in the toner memory 95 are equal to zero (0). At this time, the controller 100 determines the initial developing bias $V_{G1(n=0,\ N=0)}$ for the first toner cartridge 9 based on only the developing bias reference value $V_{G(n=0)}$ with reference to FIG. 4A because the developing bias correction amount $V_{MG(N)}$ is equal to zero (0) (see FIG. 5A). In this way, the controller 100 executes a processing of determining the initial developing bias $V_{G1(n=0,\ N=0)}$ for the first toner cartridge 9.

When the lifetime of the first toner cartridge 9 is reached, the first toner cartridge 9 is replaced with the second toner cartridge 9. In the example of FIG. 5B, at a timing when the lifetime of the first toner cartridge 9 is reached, the cumulative number of drum rotations "N" becomes equal to $N_1$. That is, at a timing when the second toner cartridge 9 is newly attached to the drum cartridge 8, the cumulative number of drum rotations "N" is equal to $N_1$, and the cumulative dot counts n is equal to zero (0). At this time, the controller 100 determines the initial developing bias $V_{G2(n=0,\ N=N1)}$ for the second toner cartridge 9 based on the developing bias reference value $V_{G(n=0)}$ and the developing bias correction amount $V_{MG(N=N1)}$. Specifically, the controller 100 determines the initial developing bias $V_{G2(n=0,\ N=N1)}$ for the second toner cartridge 9 by calculating the formula of $V_{G(n=0)}+V_{MG(N=N1)}$. Thus, the initial developing bias $V_{G2(n=0,\ N=N1)}$ of the second toner cartridge 9 differs from the initial developing bias $V_{G1(n=0,\ N=0)}$ for the first toner cartridge 9 (see FIG. 5B). In the present embodiment, the absolute value of the initial developing bias $V_{G2(n=0,\ N=N1)}$ for the second toner cartridge 9 is larger than the absolute value of the initial developing bias $V_{G1(0,\ 0)}$ for the first toner cartridge 9. That is, $|V_{G2(n=0,\ N=N1)}|>|V_{G1(n=0,\ N=0)}|$.

Similarly, as the third, fourth, and fifth toner cartridges 9 are attached to the same drum cartridge 8 in this order to perform image formation, the controller 100 execute processings of determining initial developing biases $V_{G3(n=0,\ N=N2)}$, $V_{G4(n=0,\ N=N3)}$, and $V_{G5(n=0,\ N=N4)}$ for the third, fourth and fifth toner cartridges 9 by calculating formulas: $V_{G(n=0)}+V_{MG(N=N2)}$, $V_{G(n=0)}+V_{MG(N=N3)}$, and $V_{G(n=0)}+V_{MG(N=N4)}$, respectively. The controller 100 determines the initial developing bias for the third, fourth and fifth toner cartridges 9 such that the absolute value of the initial developing bias increases according to the cumulative number of drum rotations "N". That is, $|V_{G5(n=0,\ N=N4)}|>|V_{G4(n=0,\ N=N3)}|>|V_{G3(n=0,\ N=N2)}|>|V_{G2(n=0,\ N=N1)}|$.

As illustrated in FIG. 5B, after determining the initial developing bias $V_{GX(n=0)}$ for the X-th toner cartridge 9, the controller 100 changes the developing bias $V_{GX(n,\ N)}$ for the X-th toner cartridge 9 as both of the cumulative number of drum rotations "N" and the cumulative dot count "n" increase. In other words, the controller 100 determines the developing bias $V_{GX(n,\ N)}$ for the X-th toner cartridge 9 such that the absolute value $|V_{GX(n,\ N)}|$ of the developing bias $V_G$ gradually reduces as the cumulative dot count "n" increases and the cumulative number of drum rotations "N" increases until the X-th toner cartridge 9 is replaced with a next one ((X+1)-th toner cartridge 9).

Referring back to FIG. 2, the blade bias application circuit 230 is a circuit for applying a blade bias $V_B$ to the blade 93. The controller 100 determines the value of the blade bias $V_B$ according to both of the cumulative number of drum rotations "N" stored in the drum memory 85 of the drum cartridge 8 and the cumulative dot count "n" stored in the toner memory 95 of the toner cartridge 9, and controls the blade bias application circuit 230 to apply the determined blade bias $V_B$ to the blade 93.

Specifically, the controller 100 determines the value of the blade bias $V_{BX}$ for the X-th toner cartridge 9 by adding a blade bias reference value $V_{B(n)}$, which varies according to the cumulative dot count "n", and a blade bias correction amount $V_{MB(N)}$, which varies according to the cumulative number of drum rotations "N" ($V_{BX(n,\ N)}=V_{B(n)}+V_{MB(N)}$), wherein X is an integer greater than zero (0).

Figure 4B:
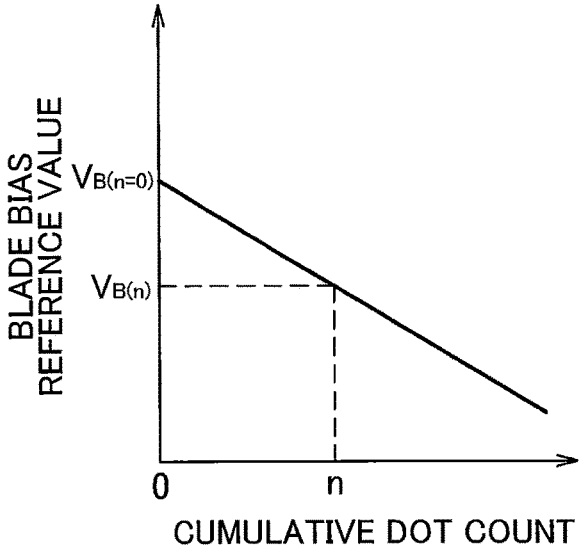
FIG. 4B is a graph showing a relationship between the cumulative dot count and a blade bias reference value according to the first embodiment.

FIG. 4B shows the relationship between the cumulative dot count "n" and the blade bias reference value $V_{B(n)}$ that should be satisfied while a single toner cartridge 9 is used for image formation, that is, after the toner cartridge 9 is newly attached to the drum cartridge 8 and until the toner cartridge 9 is replaced with a next one. The relationship (FIG. 4B) between the cumulative dot count "n" and the blade bias reference value $V_{B(n)}$ is previously determined to ensure that the amount of toner adhering to the photosensitive drum 81 will become constant even when the fluidity of the toner decreases due to the degradation of the toner with an increase in the dot count. It is noted that data of the relationship of FIG. 4B is previously determined based on previously-acquired experimental data, and is previously stored in the ROM of the controller 100. As illustrated in FIG. 4B, the blade bias reference value $V_{B(n)}$ is equal to $V_{B(0)}$ when the cumulative dot count "n" is equal to zero (n=0). The absolute value of the blade bias reference value $V_{B(n)}$ gradually decreases as the cumulative dot count "n" increases.

Figure 6A:
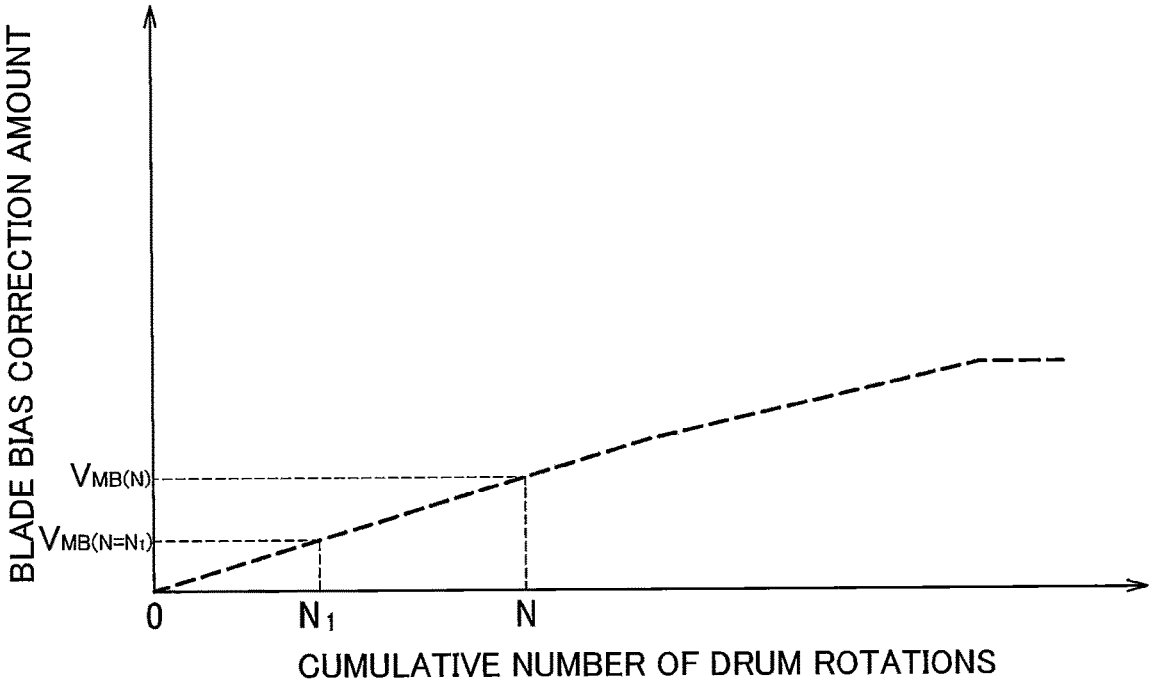
FIG. 6A is a graph showing a relationship between the cumulative number of drum rotations and a blade bias correction amount according to the first embodiment.

FIG. 6A shows the relationship between the cumulative number of drum rotations "N" and the blade bias correction amount $V_{MB(N)}$ that should be satisfied while a single drum cartridge 8 is used for image formation, that is, after the drum cartridge 8 is newly attached to the image forming apparatus 1 and until the drum cartridge 8 is replaced with a new one. The relationship (FIG. 6A) between the cumulative number of drum rotations "N" and the blade bias correction amount $V_{MB(N)}$ is previously determined to ensure that the amount of toner adhering to the photosensitive drum 81 will become constant even when the photosensitive drum 81 degrades with an increase in the cumulative number of drum rotations "N". It is noted that data of the relationship of FIG. 6A is previously determined based on previously-acquired experimental data, and is previously stored in the ROM of the controller 100. As illustrated in FIG. 6A, the blade bias correction amount $V_{MB(N)}$ is equal to zero (0) when the cumulative number of drum rotations "N" is equal zero (N=0). The absolute value of blade bias correction amount $V_{MB(N)}$ gradually increases as the cumulative number of drum rotations "N" increases.

Figure 6B:
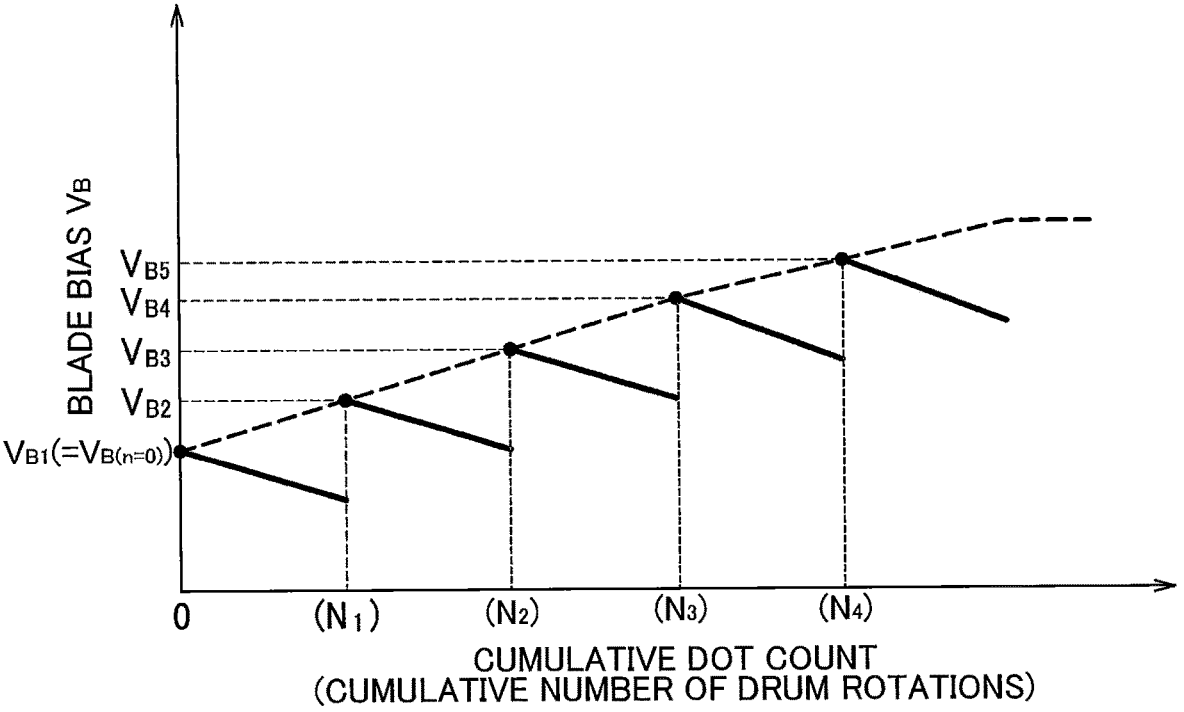
FIG. 6B is a graph showing a relationship between the cumulative dot count (cumulative number of drum rotations) and a blade bias in the case where a plurality of toner cartridges are used in succession for one drum cartridge according to the first embodiment.

As illustrated in FIG. 6B, the controller 100 determines the initial blade bias for the X-th toner cartridge 9 based on the cumulative number of drum rotations "N" that is stored at the time when the X-th toner cartridge 9 is newly assembled to the drum cartridge 8. Here, the initial blade bias for the X-th toner cartridge 9 is a bias to be applied to the blade 93 at an initial stage of the image formation performed by the X-th toner cartridge 9 together with the drum cartridge 8. In other words, the initial blade bias for the X-th toner cartridge 9 is a blade bias that is applied to the blade 93 when the cumulative dot count "n" stored in the toner memory 95 of the X-th toner cartridge 9 is equal to zero (0). More specifically, when the drum cartridge 8 is also new, both of the cumulative number of drum rotations "N" stored in the drum memory 85 and the cumulative dot count "n" stored in the toner memory 95 are equal to zero (0). At this time, the controller 100 determines the initial blade bias $V_{B1(n=0,\ N=0)}$ for the first toner cartridge 9 based on only the blade bias reference value $V_{B(n=0)}$ with reference to FIG. 4B because the blade bias correction amount $V_{MG(N)}$ is equal to zero (see FIG. 6A). In this way, the controller 100 executes a processing of determining the initial blade developing bias $V_{B1(0,\ 0)}$ for the first toner cartridge 9.

As described above, at the timing when the second toner cartridge 9 is newly attached to the drum cartridge 8, the cumulative number of drum rotations "N" is equal to $N_1$ and the cumulative dot counts n is equal to zero (0). At this time, the controller 100 determines the initial blade bias $V_{B2(n=0,\ N=N1)}$ for the second toner cartridge 9 based on the blade bias reference value $V_{B(n=0)}$ and the developing bias correction amount $V_{MB(N=N1)}$. Specifically, the controller 100 determines the initial blade bias $V_{B2(n=0,\ N=N1)}$ for the second toner cartridge 9 by calculating the formula of $V_{B(n=0)}+V_{MB(N=N1)}$. Thus, the initial blade bias $V_{B2(n=0,\ N=N1)}$ of the second toner cartridge 9 differs from the initial blade bias $V_{B1(n=0,\ N=0)}$ for the first toner cartridge 9 (see FIG. 6B). In the present embodiment, the absolute value of the initial blade bias $V_{B2(n=0,\ N=N1)}$ for the second toner cartridge 9 is larger than the absolute value of the initial blade bias $V_{B1(n=0,\ N=0)}$ for the first toner cartridge 9. That is, $|V_{B2(n=0,N=N1)}|>|V_{B1(n=0,\ N=0)}|$.

Similarly, as the third, fourth, and fifth toner cartridges 9 are attached to the same drum cartridge 8 in this order to perform image formation, the controller 100 executes processings of determining initial blade biases $V_{B3(n=0,\ N=N2)}$, $V_{B4(n=0,\ N=N3)}$, and $V_{B5(n=0,\ N=N4)}$ for the third, fourth and fifth toner cartridges 9 by calculating formulas: $V_{B(n=0)}+V_{MB(N=N2)}$, $V_{B(n=0)}+V_{MB(N=N3)}$, and $V_{B(n=0)}+V_{MB(N=N4)}$, respectively. The controller 100 determines the initial blade bias for the third, fourth and fifth toner cartridges 9 such that the absolute value of the initial blade bias increases according to the cumulative number of drum rotations "N". That is, $|V_{B5(n=0,\ N=N4)}|>|V_{B4(n=0,\ N=N3)}|>|V_{B3(n=0,\ N=N2)}|>|V_{B2(n=0,\ N=N1)}|$.

As illustrated in FIG. 6B, after determining the initial blade bias $V_{BX(n=0)}$ for the X-th toner cartridge 9, the controller 100 changes the blade bias $V_{BX(n,\ N)}$ for the toner cartridge 9 such that the blade bias $V_{BX(n,\ N)}$ changes as both of the cumulative number of drum rotations "N" and cumulative dot count "n" increase. In other words, the controller 100 determines the blade bias $V_{BX(n,\ N)}$ such that the absolute value $|V_{BX(n,\ N)}|$ of the blade bias $V_{BX(n,\ N)}$ gradually reduces as the cumulative dot count "n" increases and the cumulative number of drum rotations "N" increases until the X-th toner cartridge 9 is replaced with a next one ((X+1)-th toner cartridge 9).

Referring back to FIG. 2, the supply bias application circuit 240 is a circuit for applying a supply bias $V_K$ to the supply roller 92. The controller 100 determines the value of the supply bias $V_K$ according to both of the cumulative number of drum rotations "N" stored in the drum memory 85 of the drum cartridge 8 currently attached to the image forming apparatus 1 and the cumulative dot count "n" stored in the toner memory 95 of the toner cartridge 9 currently attached to the drum cartridge 8, and controls the supply bias application circuit 240 to apply the determined supply bias $V_K$ to the supply roller 92.

Specifically, the controller 100 determines the value of the supply bias $V_{KX}$ for the X-th toner cartridge 9 by adding a supply bias reference value $V_{K(n)}$, which varies according to the cumulative dot count "n", and a supply bias correction amount $V_{MK(N)}$, which varies according to the cumulative number of drum rotations "N" ($V_{KX(n,\ N)}=V_{K(n)}+V_{MK(N)}$), wherein X is an integer greater than zero (0).

Figure 4C:
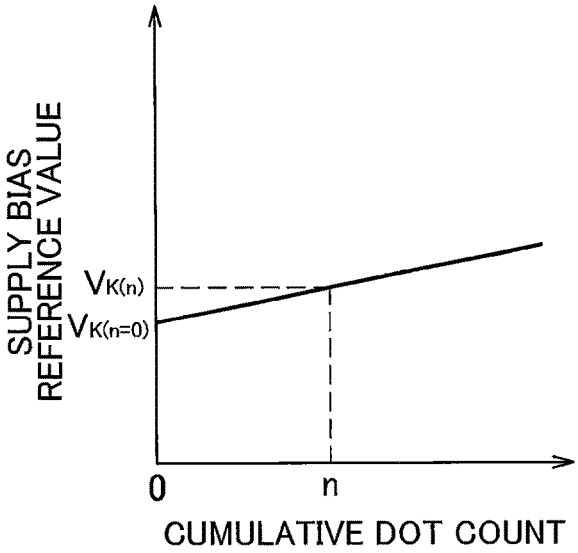
FIG. 4C is a graph showing a relationship between the cumulative dot count and a supply bias reference value according to the first embodiment.

FIG. 4C shows the relationship between the cumulative dot count "n" and the supply bias reference value $V_{K(n)}$ that should be satisfied while a single toner cartridge 9 is used for image formation, that is, after the toner cartridge 9 is newly attached to the drum cartridge 8 and until the toner cartridge 9 is replaced with a next one. The relationship (FIG. 4C) between the supply bias reference value $V_{K(n)}$ and the cumulative dot count "n" is previously determined to ensure that the amount of the toner adhering to the developing roller 91 will become constant even when the charging performance of the toner degrades due to the degradation of the toner with an increase in the dot count. It is noted that data of the relationship of FIG. 4C is previously determined based on previously-acquired experimental data, and is previously stored in the ROM of the controller 100. As illustrated in FIG. 4C, the supply bias reference value $V_{K(n)}$ is equal to $V_{K(0)}$ when the cumulative dot count "n" is equal to zero (n=0). The absolute value of the supply bias reference value $V_{K(n)}$ gradually increases as the cumulative dot count "n" increases.

Figure 7A:
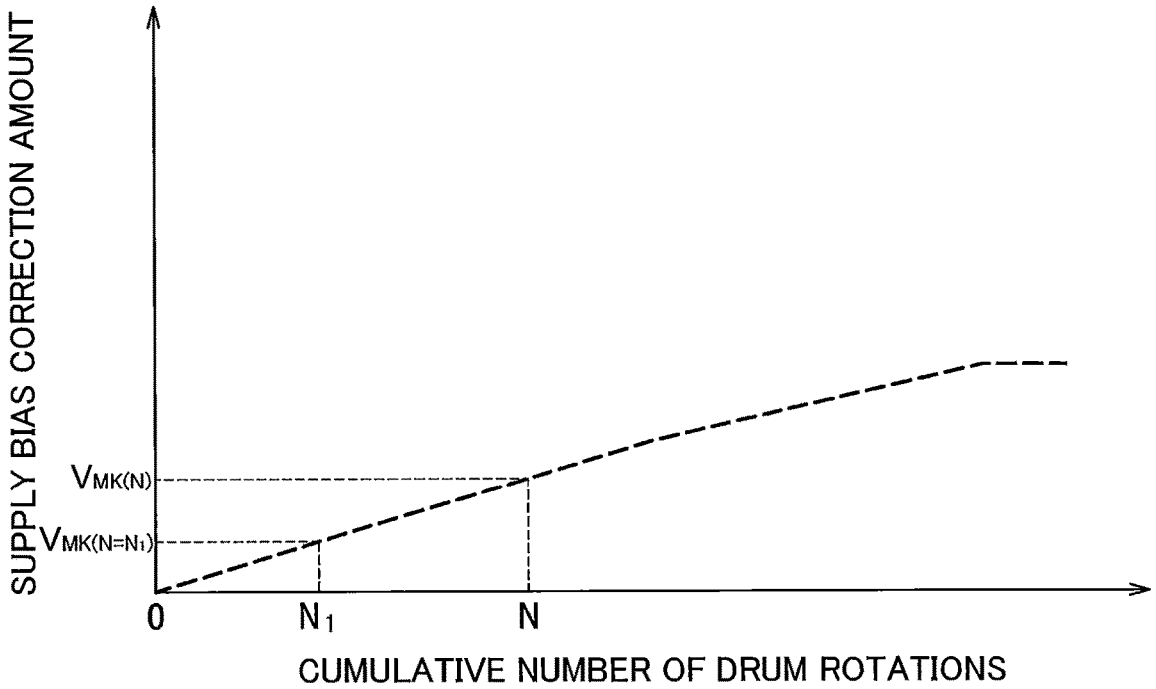
FIG. 7A is a graph showing a relationship between the cumulative number of drum rotations and a supply bias correction amount according to the first embodiment.

FIG. 7A shows the relationship between the cumulative number of drum rotations "N" and the supply bias correction amount $V_{MK(N)}$ that should be satisfied while a single drum cartridge 8 is used for image formation, that is, after the drum cartridge 8 is newly attached to the image forming apparatus 1 and until the drum cartridge 8 is replaced with a new one. The relationship (FIG. 7A) between the cumulative number of drum rotations "N" and the supply bias correction amount $V_{MK(N)}$ is previously determined to ensure that the amount of the toner adhering to the photosensitive drum 81 will become constant even when the photosensitive drum 81 degrades with an increase in the cumulative number of drum rotations "N". It is noted that data of the relationship of FIG. 7A is previously determined based on previously-acquired experimental data, and is previously stored in the ROM of the controller 100. As illustrated in FIG. 7A, the supply bias correction amount $V_{MK(N)}$ is equal to zero (0) when the cumulative number of drum rotations "N" is equal to zero (N=0). The absolute value of the supply bias correction amount $V_{MK(N)}$ gradually increases as the cumulative number of drum rotations "N" increases.

Figure 7B:
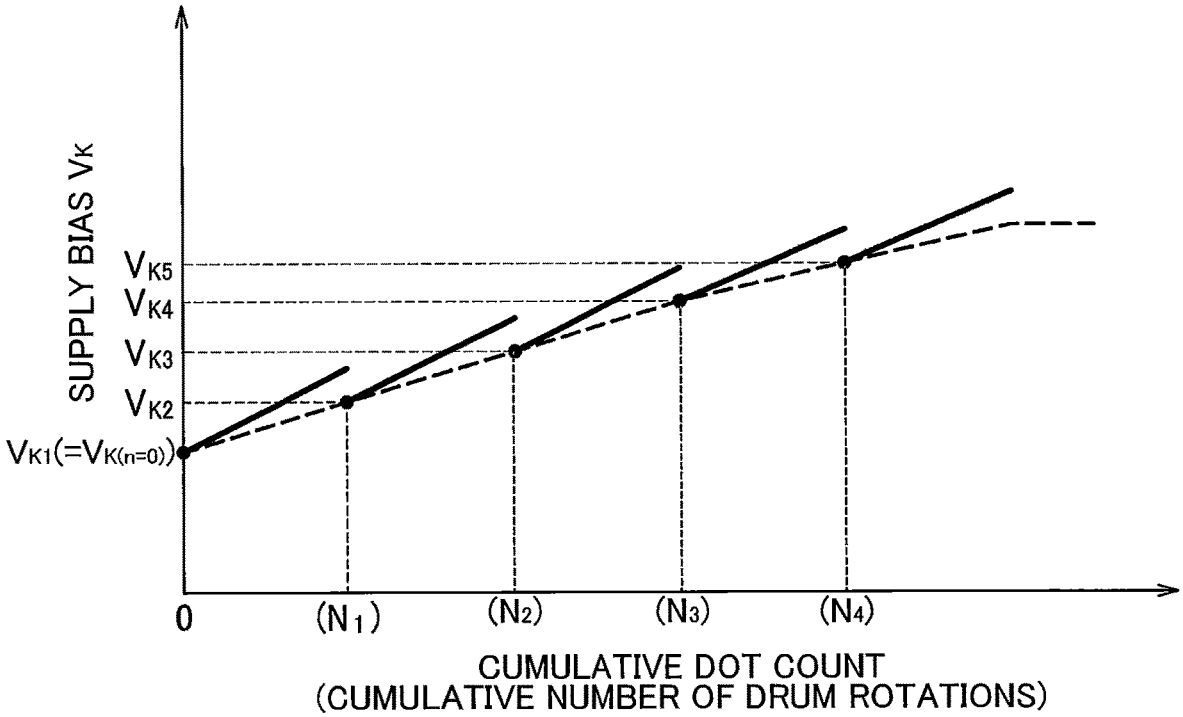
FIG. 7B is a graph showing a relationship between the cumulative dot count (the cumulative number of drum rotations) and a supply bias in the case where a plurality of toner cartridges are used in succession for one drum cartridge in the interchanging manner according to the first embodiment.

As illustrated in FIG. 7B, the controller 100 determines the initial supply bias for the X-th toner cartridge 9 based on the cumulative number of drum rotations "N" that is stored at the time when the X-th toner cartridge 9 is newly assembled to the drum cartridge 8. Here, the initial supply bias for the X-th toner cartridge 9 is a bias to be applied to the supply roller 92 at an initial stage of the image formation performed by the X-th toner cartridge 9 together with the drum cartridge 8. In other words, the initial supply bias for the X-th toner cartridge 9 is a supply bias that is applied to the supply roller 92 when the cumulative dot count "n" stored in the toner memory 95 of the X-th toner cartridge 9 is equal to zero (0). More specifically, when the drum cartridge 8 is also new, both of the cumulative number of drum rotations "N" stored in the drum memory 85 and the cumulative dot count "n" stored in the toner memory 95 are equal to zero (0). At this time, the controller 100 determines the initial supply bias $V_{K1(n=0,\ N=0)}$ for the first toner cartridge 9 based on only the developing bias reference value $V_{K(n=0)}$ with reference to FIG. 4C because the supply bias correction amount $V_{MK(N)}$ is equal to zero. In this way, the controller 100 executes a processing of determining the initial supply bias $V_{K1(n=0,\ N=0)}$ for the first toner cartridge 9.

As described above, at the timing when the second toner cartridge 9 is newly attached to the drum cartridge 8, the cumulative number of drum rotations "N" is equal to $N_1$ and the cumulative dot counts n is equal to zero (0). At this time, the controller 100 determines the initial supply bias $V_{K2(n=0,\ N=N1)}$ for the second toner cartridge 9 based on the supply bias reference value $V_{K(n=0)}$ and the supply bias correction amount $V_{MK(N=N1)}$. Specifically, the controller 100 determines the initial supply bias $V_{K2(n=0,\ N=N1)}$ for the second toner cartridge 9 by calculating the formula of $V_{K(n=0)}+V_{MK(N=N1)}$. Thus, the initial supply bias $V_{K2(n=0,\ N=N1)}$ for the second toner cartridge 9 differs from the initial supply bias $V_{K1(n=0,\ N=0)}$ of the first toner cartridge 9. In the present embodiment, the absolute value of the initial supply bias $V_{K2(n=0,\ N=N1)}$ for the second toner cartridge 9 is larger than the absolute value of the initial supply bias $V_{K1(n=0,\ N=0)}$ for the first toner cartridge 9. That is, $|V_{K2(n=0,\ N=N1)}|>|V_{K1(n=0,\ N=0)}|$.

Similarly, as the third, fourth, and fifth toner cartridges 9 are attached to the same drum cartridge 8 in this order to perform image formation, the controller 100 executes processings of determining initial supply biases $V_{K3(n=0,\ N=N2)}$, $V_{K4(n=0,\ N=N3)}$, and $V_{K5(n=0,N=N4)}$ for the third, fourth and fifth toner cartridges 9 by calculating formulas: $V_{K(n=0)}+V_{MK(N=N2)}$, $V_{K(n=0)}+V_{MK(N=N3)}$, and $V_{K(n=0)}+V_{MK(N=N4)}$, respectively. The controller 100 determines the initial supply bias for the third, fourth and fifth toner cartridges 9 such that the absolute value of the initial supply biases increases according to the cumulative number of drum rotations "N". That is, $|V_{K5(n=0,\ N=N4)}|>V_{K4(n=0,\ N=N3)}|>|V_{K3(n=0,\ N=N2)}|>|V_{K2(n=0,\ N=N1)}|$.

As illustrated in FIG. 7B, after determining the initial supply bias $V_{KX(n=0)}$ for the X-th toner cartridge 9, the controller 100 changes the supply bias $V_{KX(n,\ N)}$ for the X-th toner cartridge 9 such that the supply bias $V_{KX(n,\ N)}$ changes as both of the cumulative number of drum rotations "N" and cumulative dot count "n" increase. In other words, the controller 100 determines the supply bias $V_{KX(n,\ N)}$ for the X-th toner cartridge 9 such that the absolute value $|V_{KX(n,\ N)}|$ of the supply bias $V_{KX(n,\ N)}$ gradually increases as the cumulative dot count "n" increases and the cumulative number of drum rotations "N" increases until the X-th toner cartridge 9 is replaced with a next one ((X+1)-th toner cartridge 9).

Referring back to FIG. 2, the first motor 250 is a drive source for supplying drive force to the photosensitive drum 81. In the present embodiment, the photosensitive drum 81 is rotated by the first motor 250 in a clockwise direction in FIG. 2. The velocity of the first motor 250 is controlled by the controller 100. The second motor 260 is a drive source for supplying drive force to the developing roller 91. In the present embodiment, the developing roller 91 is rotated by the second motor 260 in a counterclockwise direction in FIG. 2. The velocity of the second motor 260 is controlled by the controller 100. The controller 100 determines a circumferential velocity difference ΔV between a circumferential velocity $V_E$ of the developing roller 91 and a circumferential velocity $V_D$ of the photosensitive drum 81 according to the increases in the cumulative dot count and cumulative number of drum rotations.

The motors 250 and 260 for driving the photosensitive drum 81 and developing roller 91 are independent from one another. Accordingly, when necessary, the controller 100 is able to change the difference between the circumferential velocity $V_D$ of the photosensitive drum 81 and the circumferential velocity $V_E$ of the developing roller 91 (i.e. the circumferential velocity difference ΔV). In the present embodiment, the circumferential velocity $V_D$ of the photosensitive drum 81 is made constant, and the circumferential velocity $V_E$ of the developing roller 91 is changed. The circumferential velocity $V_E$ of the developing roller 91 is equal to or higher than the circumferential velocity $V_D$ of the photosensitive drum 81 ($V_E \geq V_D$). Hereinafter, the circumferential velocity difference $V_E - V_D$ between the circumferential velocity $V_E$ of the developing roller 91 and the circumferential velocity $V_D$ of the photosensitive drum 81 is referred to merely as "circumferential velocity difference ΔV".

Specifically, the controller 100 determines the value of the circumferential velocity difference $\Delta V_X$ for an X-th toner cartridge 9 by adding a circumferential-velocity-difference reference value $\Delta V_{(n)}$, which varies according to the cumulative dot count "n", and a circumferential-velocity-difference correction amount $\Delta V_{M(N)}$, which varies according to the cumulative number of drum rotations "N" ($\Delta V_{X(n,\ N)} = \Delta V_{(n)} + \Delta V_{M(N)}$), wherein X is an integer greater than zero (0).

Figure 4D:
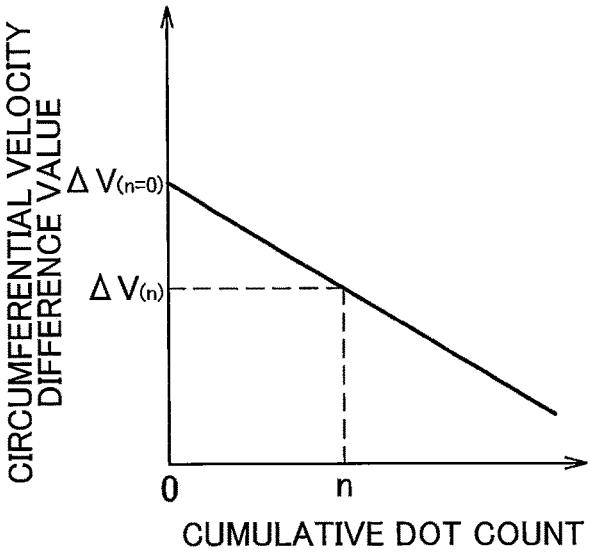
FIG. 4D is a graph showing a relationship between the cumulative dot count and a circumferential velocity difference value according to the first embodiment.

FIG. 4D shows the relationship between the cumulative dot count "n" and the circumferential-velocity-difference reference value $\Delta V_{(n)}$ that should be satisfied while a single toner cartridge 9 is used for image formation, that is, after the toner cartridge 9 is newly attached to the drum cartridge 8 and until the toner cartridge 9 is replaced with a next one. The relationship (FIG. 4D) between the cumulative dot count "n" and the circumferential-velocity-difference reference value $\Delta V_{(n)}$ is previously determined to ensure that the amount of the toner moving from the developing roller 91 to the photosensitive drum 81 will become constant even when toner degrades with an increase in the cumulative dot count "n". It is noted that data of the relationship of FIG. 4D is previously determined based on previously-acquired experimental data, and is previously stored in the ROM of the controller 100. As illustrated in FIG. 4D, the circumferential-velocity-difference reference value $\Delta V_{(n)}$ is equal to $\Delta V_0$ when the cumulative dot count is equal to zero (n=0). The circumferential-velocity-difference reference value $\Delta V_{(n)}$ gradually decreases as the cumulative dot count "n" increases.

Figure 8A:
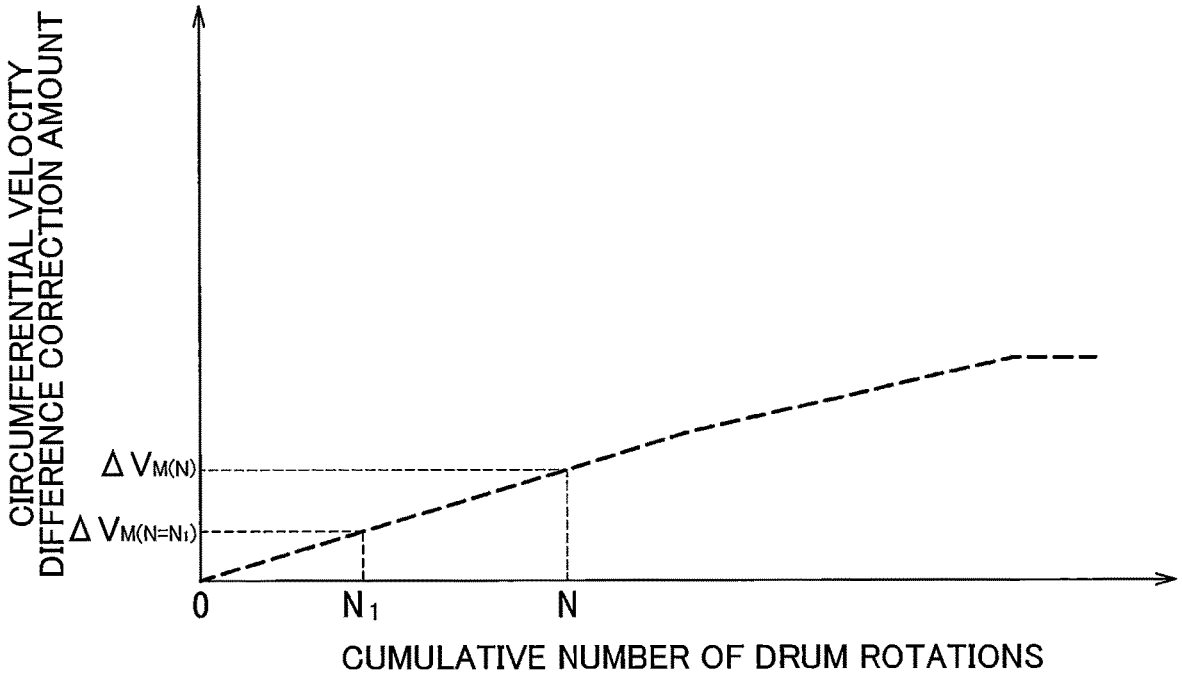
FIG. 8A is a graph showing a relationship between the cumulative number of drum rotations and a circumferential velocity difference correction amount according to the first embodiment.

FIG. 8A shows the relationship between the cumulative number of drum rotations "N" and the circumferential-velocity-difference correction amount $\Delta V_{M(N)}$ that should be satisfied while a single drum cartridge 8 is used for image formation, that is, after the drum cartridge 8 is newly attached to the image forming apparatus 1 and until the drum cartridge 8 is replaced with a next one. The relationship (FIG. 8A) between the cumulative number of drum rotations "N" and the circumferential-velocity-difference correction amount $\Delta V_{M(N)}$ is previously determined to ensure that the amount of toner adhering to the photosensitive drum 81 will become constant even when the photosensitive drum 81 degrades with an increase in the cumulative number of drum rotations "N". It is noted that data of the relationship of FIG. 8A is previously determined based on previously-acquired experimental data, and is previously stored in the ROM of the controller 100. As illustrated in FIG. 8A, the circumferential-velocity-difference correction amount $\Delta V_{M(N)}$ is equal to zero (0) when the cumulative number of drum rotations is equal to zero (N=0). The circumferential-velocity-difference correction amount $\Delta V_{M(N)}$ gradually increases as the cumulative number of drum rotations "N" increases.

Figure 8B:
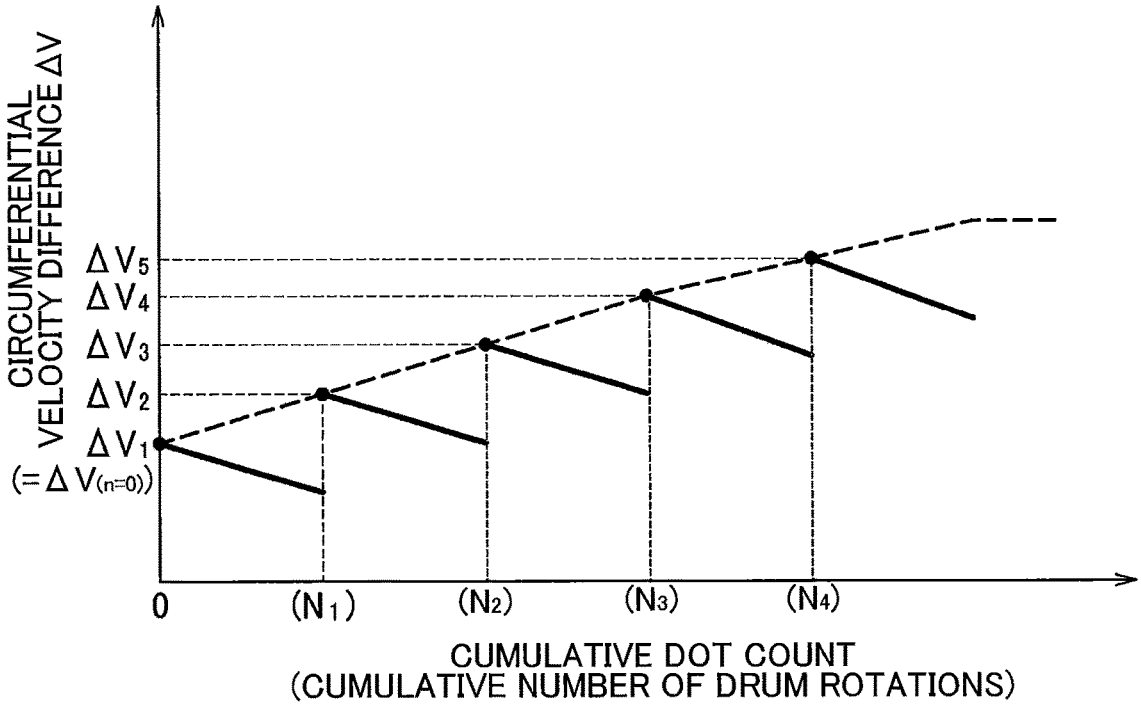
FIG. 8B is a graph showing a relationship between the cumulative dot count (the cumulative number of drum rotations) and a circumferential velocity difference in the case where a plurality of toner cartridges are used in succession for one drum cartridge according to the first embodiment.

As illustrated in FIG. 8B, the controller 100 determines the initial circumferential velocity difference $\Delta V_{X(n=0)}$ for the X-th toner cartridge 9 based on the cumulative number of drum rotations "N" that is stored at the time when the X-th toner cartridge 9 is newly assembled to the drum cartridge 8. Here, the initial circumferential velocity difference for the X-th toner cartridge 9 is a circumferential velocity difference to be attained at an initial stage of the image formation performed by the X-th toner cartridge 9 together with the drum cartridge 8. In other words, the initial circumferential velocity difference for the X-th toner cartridge 9 is a circumferential velocity difference that is attained when the cumulative dot count "n" stored in the toner memory 95 of the X-th toner cartridge 9 is equal to zero (0). More specifically, when the drum cartridge 8 is also new, both of the cumulative number of drum rotations "N" stored in the drum memory 85 and the cumulative dot count "n" stored in the toner memory 95 are equal to zero (0). At this time, the controller 100 determines the initial circumferential velocity difference $\Delta V_{1(n=0,\ N=0)}$ based on only the circumferential velocity difference reference value $\Delta V_{(n=0)}$ with reference to FIG. 4D because the circumferential velocity difference correction amount $\Delta V_{M(N)}$ is equal to zero (see FIG. 8A). In this way, the controller 100 executes a processing of determining the initial circumferential velocity difference $\Delta V_{1(0,\ 0)}$ for the first toner cartridge 9.

As described above, at the timing when the second toner cartridge 9 is newly attached to the drum cartridge 8, the cumulative number of drum rotations "N" is equal to $N_1$, and the cumulative dot counts n is equal to zero (0). At this time, the controller 100 determines the initial circumferential velocity difference $\Delta V_{2(n=0,\ N=N1)}$ for the second toner cartridge 9 based on the circumferential velocity difference reference value $\Delta V_{(n=0)}$ and the circumferential velocity difference correction amount $\Delta V_{M(N=N1)}$. Specifically, the controller 100 determines the initial circumferential velocity difference $\Delta V_{2(n=0,\ N=N1)}$ of the second toner cartridge 9 by calculating the formula of $\Delta V_{(n=0)}+\Delta V_{M(N=N1)}$. Thus, the initial circumferential velocity difference $\Delta V_{2(n=0,\ N=N1)}$ for the second toner cartridge 9 differs from the initial circumferential velocity difference $\Delta V_{1(n=0,\ N=0)}$ of the first toner cartridge 9. In the present embodiment, the initial circumferential velocity difference $\Delta V_{2(n=0,\ N=N1)}$ for the second toner cartridge 9 is larger than the initial circumferential velocity difference $\Delta V_{1(n=0,\ N=0)}$ for the first toner cartridge 9. That is, $\Delta V_{2(n=0,\ N=N1)}>\Delta V_{1(n=0,\ N=0)}$.

Similarly, as the third, fourth, and fifth toner cartridges 9 are attached to the drum cartridge 8 in this order to perform image formation, the controller 100 executes processings of determining initial circumferential velocity differences $\Delta V_{3(n=0,\ N=N2)}$, $\Delta V_{4(n=0,\ N=N3)}$, and $\Delta V_{5(n=0,\ N=N4)}$ for the third, fourth and fifth toner cartridges 9 by calculating formulas: $\Delta V_{(n=0)}+\Delta V_{M(N=N2)}$, $\Delta V_{(n=0)}+\Delta V_{M(N=N3)}$, and $\Delta V_{(n=0)}+\Delta V_{M(N=N4)}$, respectively. The controller 100 determines the initial circumferential velocity difference for the third, fourth and fifth toner cartridges 9 such that the initial circumferential velocity differences increases according to the cumulative number of drum rotations "N". That is, $\Delta V_{5(n=0,\ N=N4)}>\Delta V_{4(n=0,\ N=N3)}>\Delta V_{3(n=0,\ N=N2)}>\Delta V_{2(n=0,\ N=N1)}$.

As illustrated in FIG. 8B, after determining the initial circumferential velocity difference $\Delta V_{X(n=0)}$ for the X-th toner cartridge 9, the controller 100 changes the circumferential velocity difference $\Delta V_{X(n,\ N)}$ for the X-th toner cartridge 9 such that the circumferential velocity difference $\Delta V_{X(n,\ N)}$ changes as the cumulative number of drum rotations "N" and cumulative dot count "n" increase. In other words, the controller 100 determines the circumferential velocity difference $\Delta V_{X(n,\ N)}$ for the X-th toner cartridge 9 such that of the circumferential velocity difference $\Delta V_{X(n,\ N)}$ gradually decreases as the cumulative dot count "n" increases and the cumulative number of drum rotations "N" increases until the X-th toner cartridge 9 is replaced with a next one ((X+1)-th toner cartridge 9).

According to the above-described image forming apparatus 1, the following advantages are achieved.

According to the image forming apparatus 1, by making the initial developing bias $V_{G1(n=0,\ N=0)}$ and the initial developing bias $V_{G2(n=0,\ N=N1)}$ different (specifically, by making $|V_{G2(n=0,\ N=N1)}|$ larger than $|V_{G1(n=0,\ N=0)}|$), the amount of toner adhering to the photosensitive drum 81 when the second toner cartridge is used can be brought close to the amount of toner adhering to the photosensitive drum 81 when the first toner cartridge is used. This allows the print density of the image forming apparatus 1 to be stabilized while a plurality of toner cartridges are used in succession for one drum cartridge.

Further, the controller 100 changes the developing bias $V_{GX(n,\ N)}$ to be applied to the developing roller 91 according to an increase in the cumulative number of drum rotations "N" and to an increase in the cumulative dot count "n", so that the developing bias can be changed according to both degradation of the photosensitive drum 81 and degradation of toner.

For example, the photosensitive drum 81 degrades in charging capability in accordance with degradation of the photosensitive drum 81. Accordingly, the developing bias should be gradually increased so as to compensate for the degradation in the charging capability. On the other hand, toner increases in adhesion force in accordance with degradation of toner. Accordingly, the developing bias should be gradually reduced so as to prevent excessive adhesion. By changing the developing bias according to both degradation in charging capability of the photosensitive drum 81 and degradation of toner, the amount of toner adhering to the photosensitive drum 81 can be made constant.

Further, by making the initial blade bias $V_{B1(n=0,\ N=0)}$ and the initial blade bias $V_{B2(n=0,\ N=N1)}$ different from each other, the amount of toner adhering to the developing roller 91 of the second toner cartridge can be brought close to the amount of toner adhering to the developing roller 91 of the first toner cartridge. This stabilizes the amount of toner supplied from the developing roller 91 to the photosensitive drum 81. As a result, the print density of the image forming apparatus 1 can be stabilized.

Further, the controller 100 changes the blade bias $V_{BX(n,\ N)}$ to be applied to the developing roller 91 according to an increase in the cumulative number of drum rotations "N" and to an increase in the cumulative dot count "n", so that the developing bias can be changed according to both degradation of the photosensitive drum 81 and degradation of toner. This allows the amount of toner adhering to the photosensitive drum 81 to be made constant.

Further, by making the initial supply bias $V_{K1(n=0,\ N=0)}$ and the initial supply bias $V_{K2(n=0,\ N=N1)}$ different from each other, the amount of toner adhering to the developing roller 91 of the second toner cartridge can be brought close to the amount of toner adhering to the developing roller 91 of the first toner cartridge. This stabilizes the amount of toner supplied from the developing roller 91 to the photosensitive drum 81. As a result, the print density of the image forming apparatus 1 can be stabilized.

Further, the controller 100 changes the supply bias $V_{KX(n,\ N)}$ to be applied to the supply roller 92 according to an increase in the cumulative number of drum rotations and to an increase in the cumulative dot count, so that the supply bias can be changed according to both degradation of the photosensitive drum 81 and degradation of toner. This allows the amount of toner to be supplied to the photosensitive drum 81 to be made constant.

Further, by making the initial circumference velocity difference $\Delta V_{1(n=0,\ N=0)}$ and the initial circumference velocity difference $\Delta V_{2(n=0,\ N=N1)}$ different from each other, the amount of toner adhering to the photosensitive drum 81 when the second toner cartridge is used can be brought close to the amount of toner adhering to the photosensitive drum 81 when the first toner cartridge is used. This allows the amount of toner to be supplied from the developing roller 91 to the photosensitive drum 81 to be constant. As a result, the print density of the image forming apparatus 1 can be stabilized.

Further, the controller 100 changes the circumferential velocity difference $\Delta V_{X(n,\ N)}$ between the developing roller 91 and the photosensitive drum 81 according to increases in the cumulative number of drum rotations and the cumulative dot count, so that the circumferential velocity difference can be changed according to both degradation of the photosensitive drum 81 and degradation of toner. This allows the amount of toner to be supplied to the photosensitive drum 81 to be made constant.

Next, a second embodiment of the present disclosure will be described in detail with reference to FIGS. 9 through 12B. Since an image forming apparatus 1, a drum cartridge 8 and a toner cartridge 9 according to the second embodiment have basically the same configurations as the configurations of the image forming apparatus 1, the drum cartridge 8 and the toner cartridge 9 according to the first embodiment, only those configurations that are different from the first embodiment will be described below. Similarly to the first embodiment, a plurality of different toner cartridge 9 are used in succession together with the same, single drum cartridge 8, and each toner cartridge 9 is referred to also as an X-th toner cartridge 9 that is used X-th in the series of toner cartridge, where X is an integer greater than zero (0).

Figure 9:
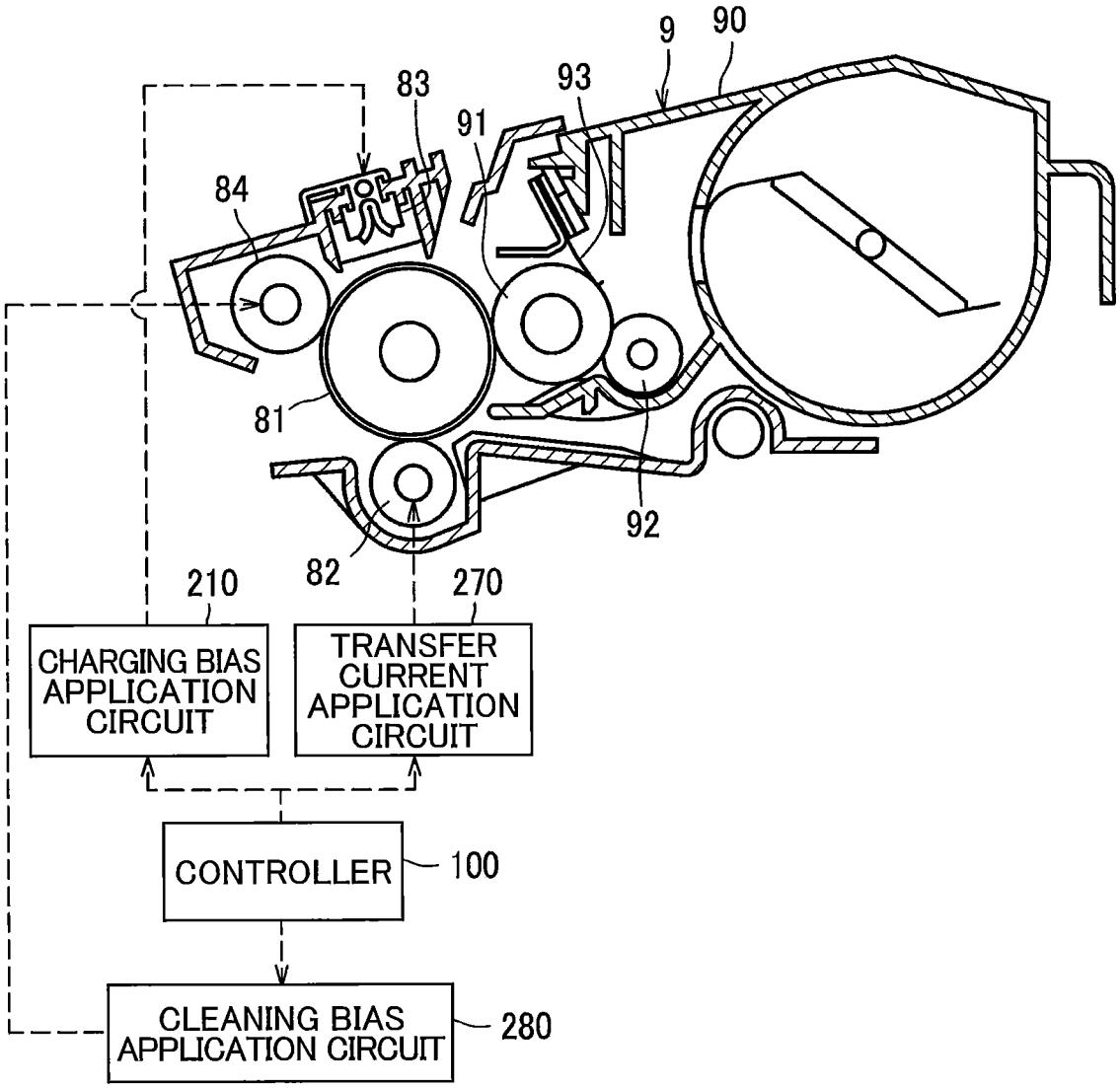
FIG. 9 is a conceptual diagram illustrating connection between a toner cartridge and a charging bias application circuit, a transfer current application circuit and a cleaning bias application circuit according to a second embodiment.

As illustrated in FIG. 9, the drum cartridge 8 of the second embodiment has a cleaning roller 84. The cleaning roller 84 is disposed at a position different from the position of the transfer roller 82 in the frame 80 of the drum cartridge 8. The cleaning roller 84 is configured to remove a residual toner and foreign substances from the photosensitive drum 81.

The image forming apparatus 1 of the second embodiment has the charging bias application circuit 210, a transfer current application circuit 270 and a cleaning bias application circuit 280. Similarly to the first embodiment, the controller 100 controls the charging bias application circuit 210 such that the value of the charging bias $V_T$ gradually increases as the cumulative number of drum rotations "N" of the photosensitive drum 81 increases as shown in FIG. 3. As described below, the controller 100 further stores data shown in FIGS. 10A, 10B, 11A and 12A in the ROM.

As illustrated in FIG. 9, the transfer current application circuit 270 is a circuit for applying a transfer current I to the transfer roller 82. The controller 100 determines the value of the transfer current I according to both of the cumulative number of drum rotations "N" that is stored in the drum memory 85 of the drum cartridge 8 currently attached to the image forming apparatus 1 and the cumulative dot count "n" that is stored in the toner memory 95 of the toner cartridge 9 currently attached to the drum cartridge 8, and controls the transfer current application circuit 270 to apply the determined transfer current I to the transfer roller 82.

Specifically, the controller 100 determines the value of the transfer current $I_X$ for an X-th toner cartridge 9 by adding a transfer current reference value $I_{(n)}$, which varies according to the cumulative dot count "n", and a transfer current correction amount $I_{(N)}$, which varies according to the cumulative number of drum rotations ($I_{X(n,\ N)}=I_{(n)+I(N)}$), wherein X is an integer greater than zero (0).

Figure 10A:
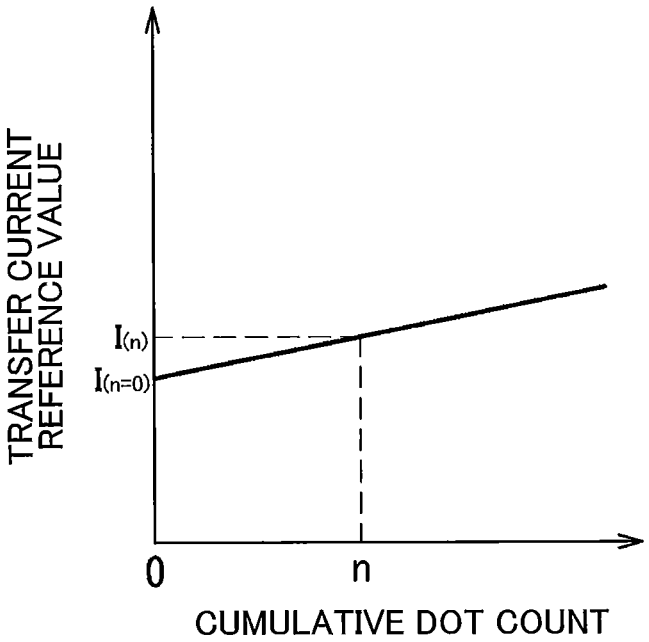
FIG. 10A is a graph showing a relationship between a cumulative dot count and a transfer current reference value according to the second embodiment.

FIG. 10A shows the relationship between the cumulative dot count "n" and the transfer current reference value $I_{(n)}$ that should be satisfied while a single toner cartridge 9 is used for image formation, that is, after the toner cartridge 9 is newly attached to the drum cartridge 8 and until the toner cartridge 9 is replaced with a next one. The relationship (FIG. 10A) between the cumulative dot count "n" and the transfer current reference value $I_{(n)}$ is previously determined to ensure that the transfer amount of toner moved from the photosensitive drum 81 to a sheet S will become constant even when the toner degrades with an increase in the dot count. It is noted that data of the relationship of FIG. 10A is previously determined based on previously-acquired experimental data, and is previously stored in the ROM of the controller 100. As illustrated in FIG. 10A, the transfer current reference value $I_{(n)}$ is equal to $I_0$ when the cumulative dot count is equal to zero (n=0). The transfer current reference value $I_{(n)}$ gradually increases as the cumulative dot count increases.

Figure 11A:
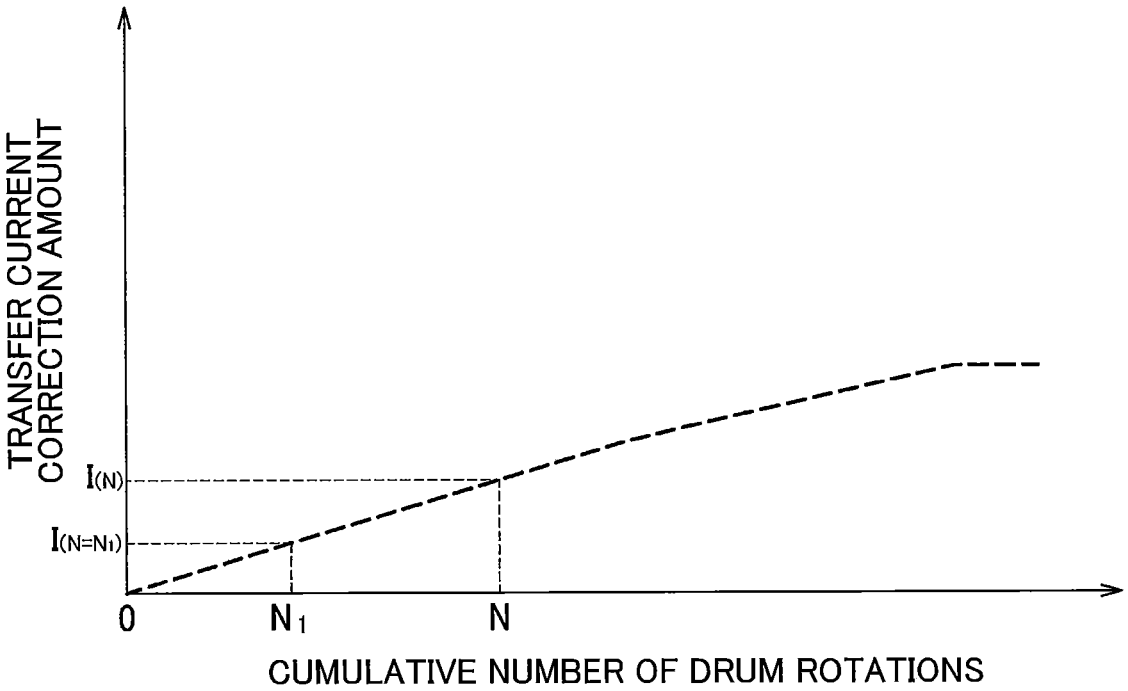
FIG. 11A is a graph showing a relationship between a cumulative number of drum rotations and a transfer current correction amount according to the second embodiment.

FIG. 11A shows the relationship between the cumulative number of drum rotations "N" and the transfer current correction amount I(N) that should be satisfied while a single drum cartridge 8 is used for image formation, that is, after the drum cartridge 8 is newly attached to the image forming apparatus 1 and until the drum cartridge 8 is replaced with a new one. The relationship (FIG. 11A) between the cumulative number of drum rotations "N" and the transfer current correction amount $I_{(N)}$ is previously determined to ensure that the transfer amount of toner moved from the photosensitive drum 81 to a sheet S will become constant even when the photosensitive drum 81 degrades with an increase in the cumulative number of drum rotations "N". It is noted that data of the relationship of FIG. 11A is determined based on previously-acquired experimental data, and is previously stored in the ROM of the controller 100. As illustrated in FIG. 11A, the transfer current correction amount $I_{(N)}$ is equal to zero (0) when the cumulative number of drum rotations "N" is equal to zero (N=0). The transfer current correction amount $I_{(N)}$ gradually increases as the cumulative number of drum rotations "N" increases.

Figure 11B:
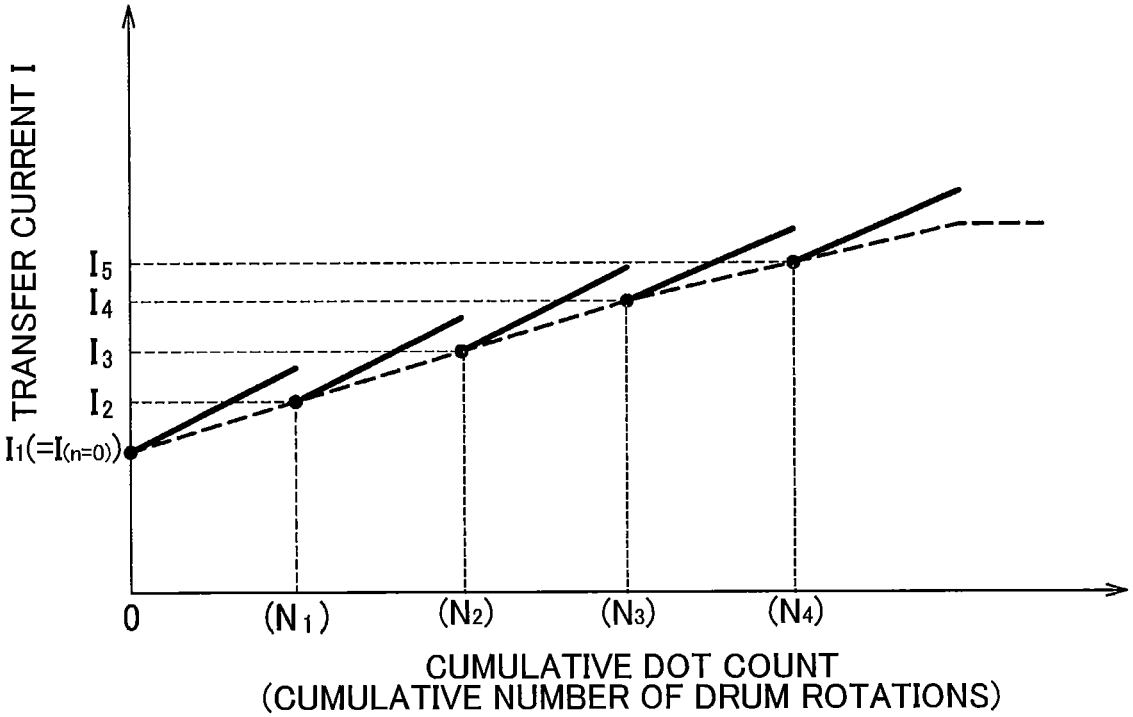
FIG. 11B is a graph showing a relationship between the cumulative dot count (the cumulative number of drum rotations) and a transfer current in a case where a plurality of toner cartridges are used for one drum cartridge.

As illustrated in FIG. 11B, the controller 100 determines the initial transfer current for the X-th toner cartridge 9 based on the cumulative number of drum rotations "N" that is stored at the time when the X-th toner cartridge 9 is newly assembled to the drum cartridge 8. Here, the initial transfer current for the X-th toner cartridge 9 is a current to be applied to the transfer roller 82 at an initial stage of the image formation performed by the X-th toner cartridge 9 together with the drum cartridge 8. In other words, the initial transfer current for the X-th toner cartridge 9 is a transfer current that is applied to the transfer roller 82 when the cumulative dot count "n" stored in the toner memory 95 in the X-th toner cartridge 9 is equal to zero (0). When the drum cartridge 8 is also new, both of the cumulative number of drum rotations "N" stored in the drum memory 85 and the cumulative dot count "n" stored in the toner memory 95 are equal to zero (0). At this time, the controller 100 determines the initial transfer current $T_{1(n=0,\ N=0)}$ based on only the transfer current reference value $I_{1(n=0)}$ with reference to FIG. 10A because the transfer current correction amount $I_{(N)}$ is equal to zero (see FIG. 11A). In this way, the controller 100 executes a processing of determining the initial transfer current $I_{1(0,\ 0)}$ for the first toner cartridge 9.

As described above, at the timing when the second toner cartridge 9 is newly attached to the drum cartridge 8, the cumulative number of drum rotations "N" is equal to $N_1$, and the cumulative dot counts n is equal to zero (0). At this time, the controller 100 determines the initial transfer current $I_{2(n=0,\ N=N1)}$ for the second toner cartridge 9 based on the transfer current reference value $I_{(n=0)}$ and the transfer current correction amount $I_{(N=N1)}$. Specifically, the controller 100 determines the initial transfer current $I_{2(n=0,\ N=N1)}$ for the second toner cartridge 9 by calculating the formula of $I_{(n=0)}+I_{(N=N1)}$. Thus, the initial transfer current $I_{2(n=0,\ N=N1)}$ of the second toner cartridge 9 differs from the initial transfer current $I_{1(n=0,\ N=0)}$ of the first toner cartridge 9. In the present embodiment, the initial transfer current $I_{2(n=0,\ N=N1)}$ for the second toner cartridge 9 is larger than the initial transfer current $I_{1(n=0,\ N=0)}$ for the first toner cartridge 9. That is, $I_{2(n=0,\ N=N1)}>I_{1(n=0,\ N=0)}$.

Similarly, as the third, fourth, and fifth toner cartridges 9 are attached to the drum cartridge 8 in this order to perform image formation, the controller 100 executes processings of determining initial transfer currents $I_{3(n=0,\ N=N2)}$, $I_{4(n=0,\ N=N3)}$, and $I_{5(n=0,\ N=N4)}$ for the third, fourth and fifth toner cartridges 9 by calculating formulas: $I_{(n=0)}+I_{(N=N2)}$, $I_{(n=0)}+I_{(N=N3)}$, and $I_{(n=0)}+I_{(N=N4)}$, respectively. The controller 100 determines the initial transfer current for the third, fourth and fifth toner cartridges 9 such that the initial transfer current increases according to the cumulative number of drum rotations "N". That is, $I_{5(n=0,\ N=N4)}>I_{4(n=0,\ N=N3)}>I_{3(n=0,\ N=N2)}>I_{2(n=0,\ N=N1)}$.

As illustrated in FIG. 11B, after determining the initial transfer current $I_{X(n=0)}$ for the X-th toner cartridge 9, the controller 100 changes the transfer current $I_{X(n,\ N)}$ for the X-th toner cartridge 9 such that the transfer current $I_{X(n,\ N)}$ changes as both of the cumulative number of drum rotations "N" and the cumulative dot count "n" increase. In other words, the controller 100 determines the transfer current $I_{X(n,\ N)}$ for the X-th toner cartridge 9 such that the transfer current $I_{X(n,\ N)}$ gradually increases as the cumulative dot count "n" increases and the cumulative number of drum rotations "N" increases until the X-th toner cartridge 9 is replaced with a next one ((X+1)-th toner cartridge 9).

Referring back to FIG. 9, the cleaning bias application circuit 280 is a circuit for applying a cleaning bias $V_C$ to the cleaning roller 84. The controller 100 determines the value of the cleaning bias $V_C$ according to both of the cumulative number of drum rotations "N" that is stored in the drum memory 85 of the drum cartridge 8 currently attached to the image forming apparatus 1 and the cumulative dot count "n" that is stored in the toner memory 95 of the toner cartridge 9 currently attached to the drum cartridge 8, and controls the cleaning bias application circuit 280 to apply the determined cleaning bias $V_C$ to the cleaning roller 84.

Specifically, the controller determines the value of the cleaning bias $V_{CX}$ for the X-th toner cartridge 9 by adding a cleaning bias reference value $V_{C(n)}$, which varies according to the cumulative dot count "n", and a cleaning bias correction amount $V_{C(N)}$, which varies according to the cumulative number of drum rotations ($V_{CX(n,\ N)}=V_{C(n)}+V_{C(N)}$) wherein X is an integer greater than zero (0).

Figure 10B:
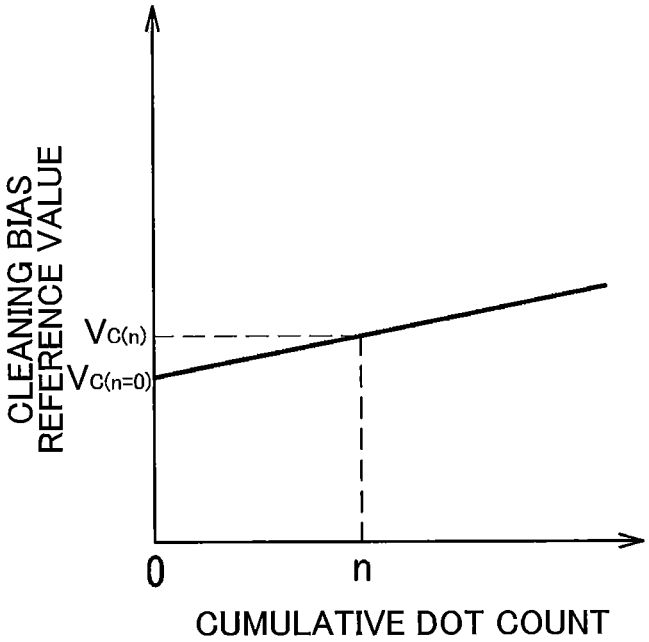
FIG. 10B is a graph showing a relationship between the cumulative dot count and a cleaning bias reference value according to the second embodiment.

FIG. 10B shows the relationship between the cumulative dot count "n" and the cleaning bias reference value $V_{C(n)}$ that should be satisfied while a single toner cartridge 9 is used for image formation, that is, after the toner cartridge 9 is newly attached to the drum cartridge 8 and until the toner cartridge 9 is replaced with a next one. The relationship (FIG. 10B) between the cumulative dot count "n" and the cleaning bias reference value $V_{C(n)}$ is previously determined to ensure that the amount of the toner removed from the photosensitive drum 81 will become constant even when the toner degrades with an increase in the dot count. It is noted that data of the relationship of FIG. 10B is previously determined based on previously-acquired experimental data, and is previously stored in the ROM of the controller 100. As illustrated in FIG. 10B, the cleaning bias reference value $V_{C(n)}$ is equal to $V_{C(n=0)}$ when the cumulative dot count "n" is equal to zero (n=0). The absolute value of the cleaning bias reference value $V_{C(n)}$ gradually increases as the cumulative dot count "n" increases.

Figure 12A:
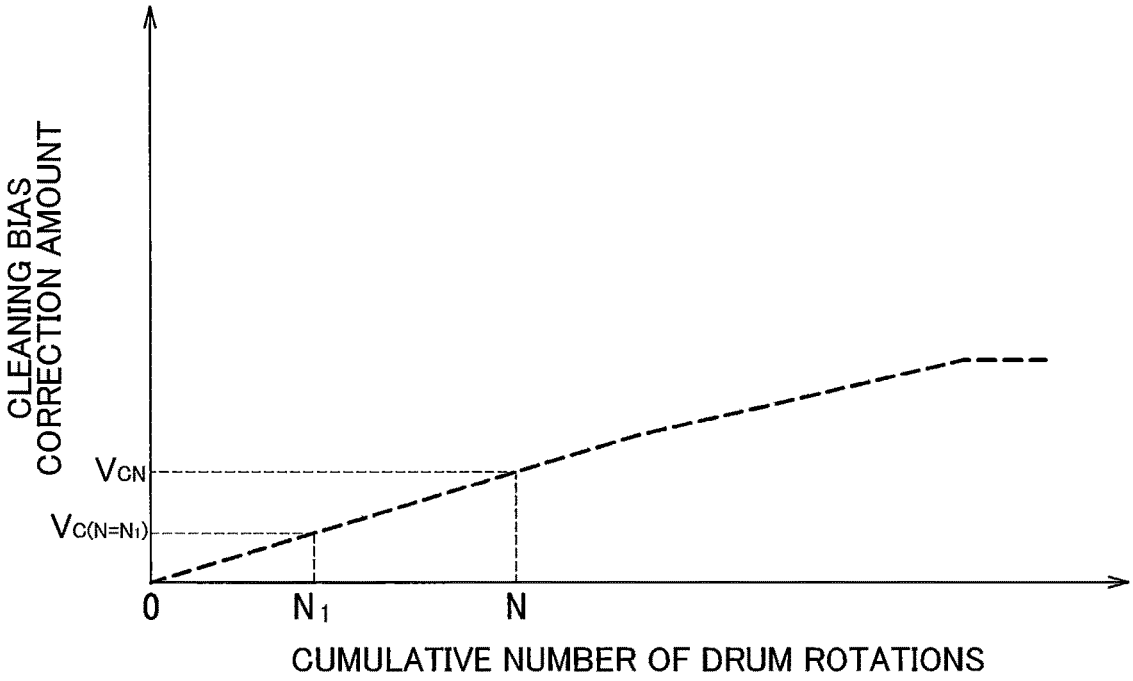
FIG. 12A is a graph showing a relationship between the cumulative number of drum rotations and a cleaning bias correction amount according to the second embodiment.

FIG. 12A shows the relationship between the cumulative number of drum rotations "N" and the cleaning bias correction amount $V_{C(N)}$ that should be satisfied while a single drum cartridge 8 is used for image formation, that is, after the drum cartridge 8 is newly attached to the image forming apparatus 1 and until the drum cartridge 8 is replaced with a next one. The relationship (FIG. 12A) between the cumulative number of drum rotations "N" and the cleaning bias correction amount $V_{C(N)}$ is previously determined to ensure that the amount of the toner removed from the photosensitive drum 81 will become constant even when the photosensitive drum 81 degrades with an increase in the cumulative number of drum rotations "N". It is noted that data of the relationship of FIG. 12A is previously determined based on previously-acquired data, and is previously stored in the ROM of the controller 100. As illustrated in FIG. 12A, the cleaning bias correction amount $V_{C(N)}$ is equal to zero (0) when the cumulative number of drum rotations "N" is equal to (N=0). The absolute value of the cleaning bias correction amount $V_{C(N)}$ gradually increases as the cumulative number of drum rotations "N" increases.

Figure 12B:
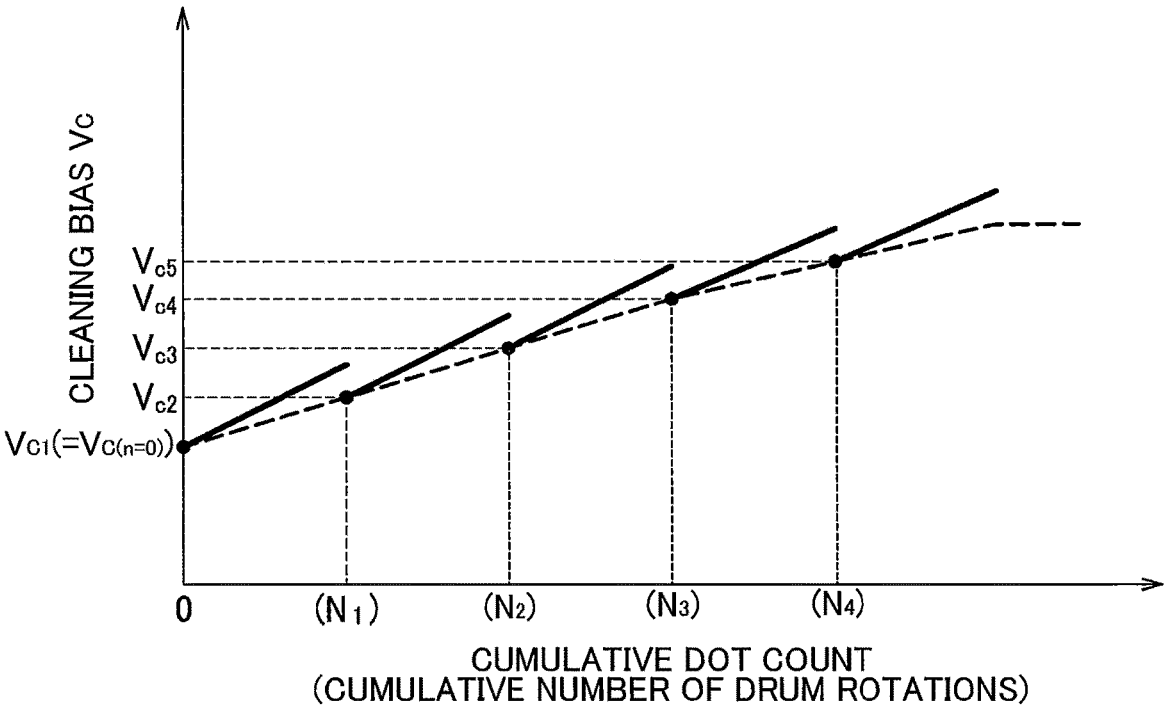
FIG. 12B is a graph showing a relationship between the cumulative dot count (the cumulative number of drum rotations) and a cleaning bias in the case where a plurality of toner cartridges are used for one drum cartridge.

As illustrated in FIG. 12B, the controller 100 determines the initial cleaning bias for the X-th toner cartridge 9 based on the cumulative number of drum rotations "N" that is stored at the time when the X-th toner cartridge 9 is newly assembled to the drum cartridge 8. Here, the initial cleaning bias for the X-th toner cartridge 9 is a cleaning bias that is to be applied to the cleaning roller 84 at an initial stage of the image formation performed by the X-th toner cartridge 9 together with the drum cartridge 8. In other words, the initial cleaning bias for the X-th toner cartridge is a cleaning bias that is applied to the cleaning roller 84 when the cumulative dot count "n" stored in the toner memory 95 of the X-th toner cartridge 9 is equal to zero (0). More specifically, when the drum cartridge 8 is also new, both of the cumulative number of drum rotations "N" stored in the drum memory 85 and the cumulative dot count "n" stored in the toner memory 95 are equal to zero (0). At this time, the controller 100 determines the initial cleaning bias $V_{C1(n=0,\ N=0)}$ based on only the cleaning bias reference value $V_{C(n=0)}$ with reference to FIG. 10B because the cleaning bias correction amount $V_{C(N)}$ is equal to zero (see FIG. 12A). In this way, the controller 100 executes a processing of determining the initial cleaning bias $V_{C1(n=0,\ N=0)}$ for the first toner cartridge 9.

As described above, at the timing when the second toner cartridge 9 is newly attached to the drum cartridge 8, the cumulative number of drum rotations "N" is equal to $N_1$, and the cumulative dot counts n is equal to zero (0). At this time, the controller 100 determines the initial cleaning bias $V_{C2(n=0,\ N=N1)}$ for the second toner cartridge 9 based on the cleaning bias reference value $V_{C(n=0)}$ and the cleaning bias correction amount $V_{C(N=N1)}$. Specifically, the controller 100 determines the initial cleaning bias $V_{C2(n=0,\ N=N1)}$ of the second toner cartridge 9 by calculating the formula of $V_{C(n=0)}+V_{C(N=N1)}$. Thus, the initial cleaning bias $V_{C2(n=0,\ N=N1)}$ of the second toner cartridge 9 differs from the initial cleaning bias $V_{C1(n=0,\ N=0)}$ of the first toner cartridge 9 (see FIG. 12B). In the present embodiment, the absolute value of the initial cleaning bias $V_{C2(n=0,\ N=N1)}$ for the second toner cartridge 9 is larger than the absolute value of the initial cleaning bias $V_{C1(n=0,\ N=0)}$ for the first toner cartridge 9. That is, $|V_{C2(n=0,\ N=N1)}|>|V_{C1(n=0,\ N=0)}|$.

Similarly, as the third, fourth, and fifth toner cartridges 9 are attached to the drum cartridge 8 in this order to perform image formation, the controller 100 executes processings of determining initial cleaning biases $V_{C3(n=0,\ N=N2)}$, $V_{C4(n=0,\ N=N3)}$, and $V_{C5(n=0,\ N=N4)}$ for the third, fourth and fifth toner cartridges 9 by calculating formulas: $V_{C(n=0)}+V_{C(N=N2)}$, $V_{C(n=0)}+V_{C(N=N3)}$, and $V_{C(n=0)}+V_{C(N=N4)}$, respectively. The controller 100 determines the initial cleaning bias for the third, fourth and fifth toner cartridges 9 such that the absolute value of the initial cleaning bias increases according to the cumulative number of drum rotations "N". That is, $|V_{C5(n=0,\ N=N4)}|>|V_{C4(n=0,\ N=N3)}|>|V_{C3(n=0,\ N=N2)}|>|V_{C2(n=0,\ N=N1)}|$.

As illustrated in FIG. 12B, after determining the initial cleaning bias $V_{CX(n=0)}$ for the X-th toner cartridge 9, the controller 100 changes the cleaning bias $V_{CX(n,\ N)}$ for the X-th toner cartridge 9 such that the cleaning bias $V_{CX(n,\ N)}$ changes as both of the cumulative number of drum rotations "N" and the cumulative dot count "n" increase. In other words, the controller 100 determines the cleaning bias $V_{CX(n,\ N)}$ fort the X-th toner cartridge 9 such that the absolute value $|V_{CX(n,\ N)}|$ of the cleaning bias $V_{CX(n,\ N)}$ gradually increases as the cumulative dot count "n" increases and the cumulative number of drum rotations "N" increases until the X-th toner cartridge 9 is replaced with a next one ((X+1)-th toner cartridge 9).

According to the above-described image forming apparatus 1 of the second embodiment, the following advantages are achieved.

After determining the initial transfer current $I_{1(n=0,\ N=0)}$ for the first toner cartridge 9, the controller 100 determines, based on the cumulative number of drum rotations "N", the initial transfer current $I_{2(n=0,\ N=N1)}$ for the second toner cartridge 9 such that the initial transfer current $I_{2(n=0,\ N=N1)}$ is different from the initial transfer current $I_{1(n=0,\ N=0)}$. In this way, even when the photosensitive drum 81 degrades with an increase in the cumulative number of drum rotations "N", the transfer amount of toner moved from the photosensitive drum 81 to a sheet S is made constant. Similarly, after determining the initial cleaning bias $V_{C1(n=0,\ N=0)}$ for the first toner cartridge 9, the controller 100 determines, based on the cumulative number of drum rotations "N", the initial cleaning bias $V_{C2(n=0,\ N=N1)}$ for the second toner cartridge 9 such that the initial cleaning bias $V_{C2(n=0,\ N=N1)}$ is different from the initial cleaning bias $V_{C1(n=0,\ N=0)}$. In this way, even when the photosensitive drum 81 degrades with the increase in the cumulative number of drum rotations "N", the amount of toner removed from the photosensitive drum 81 is made constant. This allows the print density of the image forming apparatus 1 to be stabilized while a plurality of toner cartridges are used in succession for one drum cartridge.

Further, the controller 100 changes the transfer current $I_{X(n,\ N)}$ to be applied to the transfer roller 82 according to an increase in the cumulative number of drum rotations "N" and to an increase in the cumulative dot count "n", so that the transfer current $I_{X(n,\ N)}$ will be changed according to both degradation of the photosensitive drum 81 and degradation of toner. This allows the transfer amount of the toner moved from the photosensitive drum 81 to the sheet S is made constant. Similarly, the controller 100 changes the cleaning bias $V_{CX(n,\ N)}$ to be applied to the cleaning roller 84 according to the increase in the cumulative number of drum rotations and to the increase in the cumulative dot count, so that the cleaning bias $V_{CX(n,\ N)}$ will be changed according to both degradation of the photosensitive drum 81 and degradation of toner. This allows the cleaning amount of toner removed from the photosensitive drum 81 to be constant.

Further, the controller 100 gradually increases the transfer current $I_{X(n,\ N)}$ to be applied to the transfer roller 82 as the cumulative dot count "n" increases. In this way, even when the toner stored in the toner cartridge 9 degrades, the transfer amount of the toner moved from the photosensitive drum 81 to a sheet S is made constant. More specifically, even though charging performance of toner deteriorates as toner degrades, a resultant deterioration of the toner transfer is suppressed by increasing the transfer current $I_{X(n,\ N)}$. Similarly, the controller 100 gradually increases the absolute value of the cleaning bias $V_{CX(n,\ N)}$ as the cumulative dot count "n" increases. In this way, even when the toner stored in the toner cartridge 9 degrades, the cleaning amount of the toner is made constant. More specifically, even though charging performance of toner deteriorates as toner degrades, a resultant deterioration of the cleaning amount can be suppressed by increasing the absolute value of the cleaning bias $V_{CX(n,\ N)}$.

Further, the controller 100 gradually increases the transfer current $I_{X(n,\ N)}$ as the cumulative number of drum rotations "N" increases. In this way, even when the photosensitive drum 81 degrades, the transfer amount of the toner moved from the photosensitive drum 81 to a sheet S is made constant. More specifically, as the photosensitive drum 81 deteriorates, the surface of the photosensitive drum 81 becomes rough and the adhesion of toner increases. However, a resultant decrement of the toner transfer amount can be suppressed by increasing the transfer current $I_{X(n,\ N)}$. Similarly, the controller 100 gradually increases the cleaning bias $V_{CX(n,N)}$ as the cumulative number of drum rotations "N" increases. In this way, even when the photosensitive drum 81 degrades, the toner cleaning amount is made constant. More specifically, as the photosensitive drum 81 deteriorates, the surface of the photosensitive drum 81 becomes rough and the adhesion of toner increases. However, a resultant decrement of the toner cleaning amount can be suppressed by increasing the cleaning bias $V_{CX(n,N)}$.

It is noted that the drum cartridge has already deteriorated when the second and subsequent toner cartridges are installed. Accordingly, by making the initial transfer current $I_{2(n=0,\ N=N1)}$ larger than the initial transfer current $I_{1(0,\ 0)}$, the amount of toner transferring from the photosensitive drum 81 to a sheet S when the second toner cartridge is used can be brought close to the amount of toner transferring from the photosensitive drum to a sheet S when the first toner cartridge is used. This allows the print density of the image forming apparatus 1 to be stabilized while a plurality of toner cartridges are used in succession for one drum cartridge such that when toner runs out in one toner cartridge, the toner cartridge is replaced with the next toner cartridge. Similarly, by making the absolute value of the initial cleaning bias $|V_{C2(n=0,\ N=N1)}|$ larger than $|V_{C1(n=0,\ N=0)}|$, the cleaning amount of toner removed from the photosensitive drum 81 when the second toner cartridge is used can be brought close to the cleaning amount of toner removed from the photosensitive drum 81 when the first toner cartridge is used. This allows the print density of the image forming apparatus 1 to be stabilized while a plurality of toner cartridges are used in succession for one drum cartridge.

The present disclosure is not limited to the above-described embodiments and can be applied to various forms as exemplified below.

While the positively charged type toner is used in the first embodiment, negatively charged type toner may be used. In this case, the charging bias application circuit 210, developing bias application circuit 220, blade bias application circuit 230, and supply bias application circuit 240 may each be applied with negative bias voltage.

While the positively charged type toner is used in the second embodiment, negatively charged type tone may be used. In this case, the charging bias application circuit 210 and the cleaning bias application circuit may each be applied with negative bias voltage.

While the controller 100 reduces the absolute value $|V_{GX(n,\ N)}|$ of the developing bias $V_{GX(n,\ N)}$ as the cumulative dot count of the toner cartridge 9 increases in the first embodiment, the developing bias may be determined according to the cumulative number of drum rotations or the residual amount of toner stored in the toner cartridge 9, in place of the cumulative dot count. Similarly, the circumferential velocity difference $\Delta V_{X(n,\ N)}$ between the photosensitive drum and the developing roller may be determined according to the cumulative number of drum rotations or the residual amount of toner stored in the toner cartridge 9, in place of the cumulative dot count.

While the circumferential velocity of the photosensitive drum 81 is constant in the first embodiment, the circumferential velocity of the photosensitive drum 81 may not necessarily be constant but may be changed. Further, while the circumferential velocity of the developing roller 91 is higher than the circumferential velocity of the photosensitive drum 81 in the first embodiment, the circumferential velocity of the developing roller 91 may be equal to or lower than the circumferential velocity of the photosensitive drum 81.

While the photosensitive drum 81 and developing roller 91 are driven by separate motors (i.e. the first motor 250 and the second motor 260) in the first embodiment, the photosensitive drum 81 and developing roller 91 may be driven by a single common motor. In this case, the developing roller and motor may be connected together through a transmission mechanism that is capable of changing a transmission ratio.

In the second embodiment, the drum cartridge 8 includes both of the transfer roller 82 and the cleaning roller 84. After determining both of the initial transfer current $I_{1(n=0,\ N=0)}$ and the initial cleaning bias $V_{C1(n=0,\ N=0)}$ for the first toner cartridge 9, the controller 100 determines for the second toner cartridge 9 the initial transfer current $I_{2(n=0,\ N=N1)}$ different from the initial transfer current $I_{1(n=0,\ N=0)}$ and the initial cleaning bias $V_{C2(n=0,\ N=N1)}$ different from the initial cleaning bias $V_{C1(n=0,\ N=0)}$ based on the cumulative number of the drum rotations N. However, the drum cartridge 8 may include at least one of the transfer roller 82 and the cleaning roller 84. If the drum cartridge 8 includes the transfer roller 82 but does not include the cleaning roller 84, after determining the initial transfer current $I_{1(n=0,\ N=0)}$, the controller 100 determines the initial transfer current $I_{2(n=0,\ N=N1)}$ different from the initial transfer current $I_{1(n=0,\ N=0)}$ based on the cumulative number of drum rotations "N. If the drum cartridge 8 includes the cleaning roller 84 but does not include the transfer roller 82, after determining the initial cleaning bias $V_{C1(n=0,\ N=0)}$, the controller 100 determines the initial cleaning bias $V_{C2(n=0,\ N=N1)}$ different from the initial cleaning bias $V_{C1(n=0,\ N=0)}$ based on the cumulative number of drum rotations "N".

While the controller 100 increases the transfer current I as the cumulative dot count "n" of the toner cartridge 9 increases in the second embodiment, the current value may be determined according to the cumulative number of drum rotations "N" or according to the residual amount of toner stored in the toner cartridge 9, in place of the cumulative dot count "n".

While the monochrome laser printer is exemplified as the image forming apparatus in each of the first and second embodiments, the image forming apparatus to be used in the present disclosure may be a color laser printer and, a copying machine, or a multifunction machine, or the like.

The components described in the first and second embodiments and modifications may arbitrarily be combined.

While the description has been made in detail with reference to the embodiments thereof, it would be apparent to those skilled in the art that many modifications and variations may be made therein without departing from the spirit of the disclosure.

What is claimed is:

1. An image forming apparatus comprising:

an apparatus body;

a controller;

a drum cartridge detachably attachable to the apparatus body, the drum cartridge comprising:

a photosensitive drum; and a drum memory storing data of a cumulative number of drum rotations of the photosensitive drum; and a toner cartridge configured to be used to perform image formation together with the drum cartridge, a first toner cartridge being used as the toner cartridge, before a second toner cartridge is used as the toner cartridge, the toner cartridge comprising:

a developing roller configured to be applied with a developing bias, a first developing bias being the developing bias applied to the developing roller of the first toner cartridge, a second developing bias being the developing bias applied to the second toner cartridge; and a toner memory storing data of a cumulative dot count, an initial developing bias being the developing bias that is applied to the developing roller of the toner cartridge when the cumulative dot count stored in the toner memory of the toner cartridge is equal to zero, a first initial developing bias being the initial developing bias for the first toner cartridge, a second initial developing bias being the initial developing bias for the second toner cartridge, the controller being configured to perform:

determining a value of the first initial developing bias based on the cumulative number of drum rotations that is stored in the drum memory at the time when the cumulative dot count stored in the toner memory of the first toner cartridge is equal to zero; and after determining the first initial developing bias, determining a value of the second initial developing bias based on the cumulative number of drum rotations that is stored in the drum memory at the time when the cumulative dot count stored in the toner memory of the second toner cartridge is equal to zero, the value of the second initial developing bias being different from the value of the first initial developing bias.

2. The image forming apparatus according to claim 1, wherein, in a case where the toner cartridge is used for image formation, the controller changes a value of the developing bias in accordance with increases in both of the cumulative number of drum rotations and the cumulative dot count.

3. The image forming apparatus according to claim 2, wherein, in the case where the toner cartridge is used for image formation, the controller changes the value of the developing bias such that an absolute value of the developing bias decreases in accordance with increase of the cumulative dot count.

4. The image forming apparatus according to claim 2, wherein, in the case where the toner cartridge is used for image formation, the controller changes the value of the developing bias such that an absolute value of the developing bias decreases in accordance with increase of the cumulative number of drum rotations.

5. The image forming apparatus according to claim 1, wherein the controller sets the first initial developing bias and the second initial developing bias such that an absolute value of the second initial developing bias is larger than an absolute value of the first initial developing bias.

6. The image forming apparatus according to claim 1, wherein the toner cartridge further comprises a blade configured to be applied with a blade bias and to restrict a layer thickness of the toner supplied to the developing roller, a first blade bias being the blade bias applied to the blade of the first toner cartridge, a second blade bias being the blade bias applied to the blade of the second toner cartridge, an initial blade bias being the blade bias that is applied to the blade of the toner cartridge when the cumulative dot count stored in the toner memory of the toner cartridge is equal to zero, a first initial blade bias being the initial blade bias for the first toner cartridge, a second initial blade bias being the initial blade bias for the second toner cartridge, and wherein the controller is further configured to perform:

determining a value of the first initial blade bias based on the cumulative number of drum rotations that is stored in the drum memory at the time when the cumulative dot count stored in the toner memory of the first toner cartridge is equal to zero; and after determining the first initial blade bias, determining a value of the second initial blade bias based on the cumulative number of drum rotations that is stored in the drum memory at the time when the cumulative dot count stored in the toner memory of the second toner cartridge is equal to zero, the value of the second initial developing bias being different from the value of the first initial blade bias.

7. The image forming apparatus according to claim 6, wherein, in a case where the toner cartridge is used for image formation, the controller changes a value of the blade bias in accordance with increases in both of the cumulative number of drum rotations and the cumulative dot count.

8. The image forming apparatus according to claim 7, wherein, in the case where the toner cartridge is used for the image formation, the controller changes the value of the blade bias such that an absolute value of the blade bias decreases in accordance with increase of the cumulative dot count.

9. The image forming apparatus according to claim 7, wherein, in the case where the toner cartridge is used for the image formation, the controller changes the value of the blade bias such that an absolute value of the blade bias decreases in accordance with increase of the cumulative number of drum rotations.

10. The image forming apparatus according to claim 6, wherein the controller sets the first initial blade bias and the second initial blade bias such that an absolute value of the second initial blade bias is larger than an absolute value of the first initial blade bias.

11. The image forming apparatus according to claim 1, wherein the toner cartridge comprises a supply roller configured to be applied with a supply bias and to supply toner to the developing roller, a first supply bias being the supply bias applied to the supply roller of the first toner cartridge, a second supply bias being the supply bias of the second toner cartridge, an initial supply bias being the supply bias that is applied to the supply roller when the cumulative dot count stored in the toner memory of the toner cartridge is equal to zero, a first initial supply bias being the initial supply bias for the first toner cartridge, a second supply bias being the initial bias for the second toner cartridge, and wherein the controller is further configured to perform:

determining a value of the first initial supply bias based on the cumulative number of drum rotations that is stored in the drum memory at the time when the cumulative dot count stored in the toner memory of the first toner cartridge is equal to zero; and after determining the first initial supply bias, determining a value of the second initial supply bias based on the cumulative number of drum rotations that is stored in the drum memory at the time when the cumulative dot count stored in the toner memory of the second toner cartridge is equal to zero, the value of the second initial blade bias being different from the value of the first initial blade bias.

12. The image forming apparatus according to claim 11, wherein, in a case where the toner cartridge is used for image formation, the controller changes a value of the supply bias in accordance with increases in both of the cumulative number of drum rotations and the cumulative dot count.

13. The image forming apparatus according to claim 12, wherein, in the case where the toner cartridge is used for image formation, the controller changes the value of the supply bias such that an absolute value of the supply bias increases in accordance with increase of the cumulative dot count.

14. The image forming apparatus according to claim 12, wherein, in the case where the toner cartridge is used for image formation, the controller changes the value of the supply bias such that an absolute value of the supply bias increases in accordance with increase of the cumulative number of drum rotations.

15. The image forming apparatus according to claim 11, wherein the controller sets the first initial supply bias and the second initial supply bias such that an absolute value of the second initial supply bias is larger than an absolute value of the first initial supply bias.

16. The image forming apparatus according to claim 1, wherein the photosensitive drum and the developing roller are configured to rotate with a circumferential velocity difference therebetween, a first circumferential velocity difference being the circumferential velocity difference between the photosensitive drum and the developing roller of the first toner cartridge, a second circumferential velocity difference being the circumferential velocity difference between the photosensitive drum and the developing roller of the second toner cartridge, an initial circumferential velocity difference being the circumferential velocity difference when the cumulative dot count stored in the toner memory of the toner cartridge is equal to zero, a first initial circumferential velocity difference being the initial circumferential velocity difference for the first toner cartridge, a second initial circumferential velocity difference being the initial circumferential velocity difference for the second toner cartridge, and wherein the controller is further configured to perform:

determining a value of the first initial circumferential velocity difference based on the cumulative number of drum rotations that is stored in the drum memory at the time when the cumulative dot count stored in the toner memory of the first toner cartridge is equal to zero; and after determining the first initial circumferential velocity difference, determining a value of the second initial circumferential velocity difference based on the cumulative number of drum rotations that is stored in the toner memory at the time when the cumulative dot count stored in the toner memory of the second toner cartridge is equal to zero, the value of the second initial circumferential velocity difference being different from the value of the first initial circumferential velocity difference.

17. The image forming apparatus according to claim 16, wherein, in a case where the toner cartridge is used for image formation, the controller changes a value of the circumferential velocity difference in accordance with increases in both of the cumulative number of drum rotations and the cumulative dot count.

18. The image forming apparatus according to claim 17, wherein, in the case where the toner cartridge is used for image formation, the controller changes the value of the circumferential velocity difference such that the value of the circumferential velocity difference decreases in accordance with increase of the cumulative dot count.

19. The image forming apparatus according to claim 17, wherein, in the case where the toner cartridge is used for image formation, the controller changes the value of the circumferential velocity difference such that the value of the circumferential velocity difference decreases in accordance with increase of the cumulative number of drum rotations.

20. The image forming apparatus according to claim 16, wherein the controller sets the first initial circumferential velocity difference and the second initial circumferential velocity difference such that the value of the second initial circumferential velocity difference is larger than the value of the first initial circumferential velocity difference.

21. The image forming apparatus according to claim 1, wherein the toner cartridge is detachably attachable to the drum cartridge.

22. An image forming apparatus comprising:

an apparatus body;

a controller;

a drum cartridge detachably attachable to the main body, the drum cartridge comprising:

a photosensitive drum;

at least one of a transfer roller and a cleaning roller that face the photosensitive drum, the transfer roller being configured to be applied with a transfer current, the cleaning roller being configured to be applied with a cleaning bias; and a drum memory storing data of a cumulative number of drum rotations of the photosensitive drum; and a toner cartridge configured to be used to perform image formation together with the drum cartridge, a first toner cartridge being used as the toner cartridge before a second toner cartridge is used as the toner cartridge, a first transfer current being the transfer current applied to the transfer roller when the first toner cartridge is used, a second transfer current being the transfer current applied to the transfer roller when the second toner cartridge is used, a first cleaning bias being the cleaning bias applied to the cleaning roller when the first toner cartridge is used, a second cleaning bias being the cleaning bias applied to the cleaning roller when the second toner cartridge is used, the toner cartridge comprising:

a cartridge housing accommodating toner therein;

a developing roller; and a toner memory storing data of a cumulative dot count, an initial transfer current being the transfer current that is applied to the transfer roller when the cumulative dot count stored in the toner memory of the toner cartridge is equal to zero, a first initial transfer current being the initial transfer current that is applied to the transfer roller when the first toner cartridge is used, a second initial transfer current being the initial transfer current that is applied to the transfer roller when the second toner cartridge is used, an initial cleaning bias being the cleaning bias that is applied to the cleaning roller of the drum cartridge when the cumulative dot count stored in the toner memory of the toner cartridge is equal to zero, a first initial cleaning bias being the initial cleaning bias when the first toner cartridge is used, a second initial cleaning bias being the initial cleaning bias when the second toner cartridge is used, in a case where the drum cartridge comprises the transfer roller, the controller being configured to perform:

determining a value of the first initial transfer current based on the cumulative number of drum rotations that is stored in the drum memory at the time when the cumulative dot count stored in the toner memory of the first toner cartridge is equal to zero; and after determining the first initial transfer current, determining a value of the second initial transfer current based on the cumulative number of drum rotations that is stored in the drum memory at the time when the cumulative dot count stored in the toner memory of the second toner cartridge is equal to zero, the value of the second initial transfer current being different from the value of the first initial transfer current, in a case where the drum cartridge comprises the cleaning roller, the controller being configured to perform:

determining a value of the initial cleaning bias based on the cumulative number of drum rotations that is stored in the drum memory at the time when the cumulative dot count stored in the toner memory of the first toner cartridge is equal to zero; and after determining the first initial cleaning bias, determining a value of the second initial cleaning bias based on the cumulative number of drum rotations that is stored in the drum memory at the time when the cumulative dot count stored in the toner memory of the second toner cartridge is equal to zero, the value of the second initial cleaning bias being different from the value of the first initial cleaning bias.

23. The image forming apparatus according to claim 22, wherein, in the case where the drum cartridge comprises the transfer roller, the controller changes the value of the transfer current in accordance with increases in both of the cumulative number of drum rotations and the cumulative dot count, in a state that the toner cartridge is used for image formation, and wherein, in the case where the drum cartridge comprises the cleaning roller, the controller changes the value of the cleaning bias in accordance with increases in both of the cumulative number of drum rotations and the cumulative dot count, in a state that the toner cartridge is used for image formation.

24. The image forming apparatus according to claim 23, wherein, in the case where the drum cartridge comprises the transfer roller, the controller changes the value of the transfer current such that the value of the transfer current increases in accordance with increase of the cumulative dot count, in the state that the toner cartridge is used for image formation, and wherein, in the case where the drum cartridge comprises the cleaning roller, the controller changes the value of the cleaning bias such that an absolute value of the cleaning bias increases in accordance with increase of the cumulative dot count, in the state that the toner cartridge is used for image formation.

25. The image forming apparatus according to claim 23, wherein, in the case where the drum cartridge comprises the transfer roller, the controller changes the value of the transfer current such that the value of the transfer current increases in accordance with increase of the cumulative number of drum rotations, in the state that the toner cartridge is used for image formation, and wherein, in the case where the drum cartridge comprises the cleaning roller, the controller changes the value of the cleaning bias such that an absolute value of the cleaning bias increases in accordance with increase of the cumulative number of drum rotations, in the state that the toner cartridge is used for image formation.

26. The image forming apparatus according to claim 22, wherein, in the case where the drum cartridge comprises the transfer roller, the controller sets the first initial transfer current and the second initial transfer current such that the value of the second initial transfer current is larger than the first initial transfer current, and wherein, in the case where the drum cartridge comprises the cleaning roller, the controller sets the first initial cleaning bias and the second initial cleaning bias such that an absolute value of the second initial cleaning bias is larger than an absolute value of the first initial cleaning bias.

27. The image forming apparatus according to claim 22, wherein the toner cartridge is detachably attachable to the drum cartridge.

28. The image forming apparatus according to claim 22, wherein the drum cartridge comprises both of the transfer roller and the cleaning roller, and wherein the controller is configured to perform:

determining both of the value of the first initial transfer current and the value of the second initial cleaning bias;

after determining the value of the first initial transfer current and the value of the first initial cleaning bias, determining the value of the second initial transfer current and the value of the second initial cleaning bias.

* * * * *